US006737572B1

(12) United States Patent
Jameson et al.

(10) Patent No.: US 6,737,572 B1
(45) Date of Patent: May 18, 2004

(54) VOICE CONTROLLED ELECTRONIC MUSICAL INSTRUMENT

(75) Inventors: John W. Jameson, San Carlos, CA (US); Mark B. Ring, Irvine, CA (US)

(73) Assignee: Alto Research, LLC, San Carlos, CA (US)

( * ) Notice: Subject to any disclaimer, the term of this patent is extended or adjusted under 35 U.S.C. 154(b) by 0 days.

(21) Appl. No.: 09/979,340

(22) PCT Filed: May 19, 2000

(86) PCT No.: PCT/US00/13721

§ 371 (c)(1),
(2), (4) Date: Nov. 20, 2001

(87) PCT Pub. No.: WO00/72303

PCT Pub. Date: Nov. 30, 2000

Related U.S. Application Data

(60) Provisional application No. 60/135,014, filed on May 20, 1999.

(51) Int. Cl.[7] ..... G10H 1/46; G10H 3/12

(52) U.S. Cl. ..... 84/741; 84/743

(58) Field of Search ..... 84/741, 743

(56) References Cited

U.S. PATENT DOCUMENTS

| | | | | |
|---|---|---|---|---|
| 1,393,542 A | | 10/1921 | Pitt et al. | |
| 3,634,596 A | | 1/1972 | Rupert | 84/1.28 |
| 4,342,244 A | | 8/1982 | Perkins | 84/1.01 |
| 4,463,650 A | | 8/1984 | Rupert | 84/1.19 |
| 4,633,748 A | | 1/1987 | Takashima et al. | 84/1.01 |
| 4,757,737 A | | 7/1988 | Conti | 84/1.12 |
| 4,771,671 A | | 9/1988 | Hoff, Jr. | 84/1.01 |
| 5,024,133 A | * | 6/1991 | Nakanishi et al. | 84/615 |
| 5,428,708 A | * | 6/1995 | Gibson et al. | 704/270 |
| 5,619,004 A | | 4/1997 | Dame | 811/616 |
| 6,124,544 A | * | 9/2000 | Alexander et al. | 84/616 |
| 6,372,973 B1 | * | 4/2002 | Schneider | 84/609 |

FOREIGN PATENT DOCUMENTS

| | | | |
|---|---|---|---|
| DE | 30 09 864 | 3/1980 | G10H/1/00 |

* cited by examiner

*Primary Examiner*—Jeffrey Donels
(74) *Attorney, Agent, or Firm*—Glenn Patent Group; Michael A. Glenn

(57) ABSTRACT

The invention is an electronic, voice-controlled musical instrument. It is in essence an electronic kazoo. The player hums into the mouthpiece, and the device imitates the sound of a musical instrument whose pitch and volume change in response to the player's voice. The player is given the impression of playing the actual instrument and controlling it intimately with the fine nuances of his voice. The instrument can in principle be any music-producing sound source: a trumpet, trombone, clarinet, flute, piano, electric guitar, voice, whistle, even a chorus of voices, i.e. virtually any source of sound. In its simplest configuration, the instrument resembles a kind of horn. However, the shape and appearance of the instrument can be fashioned by the manufacture to match the sound of any traditional instrument, if desired; or its shape can be completely novel. The functional requirements of the invention's physical design are only: that it be hand-held; that it have a mouthpiece (5) where the player's voice enters; that it have one or more speakers (3) where the sound is produced; that it have a body (11) where the electronics and batteries are stored and where finger-actuated controls **(1*a*, 1*b*)** can be placed. There primary software components of the invention are the frequency-detection module, the loudness-tracking module, and the note-attack module. The frequency-detection module (FDM) identifies the frequency of the player's voice. It does this by analyzing the incoming sound wave and finding patterns of recurring shapes. This method is a highly computationally efficient and novel combination of auto-correlation and zero crossing- or peak-based pitch detection. The chosen instrument is synthesized at the pitch determined by the FDM or at an offset from that pith as desired by the player. The loudness-tracking component measures the loudness of the player's voice, and this information is used then to set the volume of the synthesized sound. The note-attack module detects abrupt changes in the loudness of the player's voice. This component helps decide when the synthesized instrument should begin a new note.

49 Claims, 29 Drawing Sheets

```
Define:  t ② the current time step, t
         sample (t) ② the sample value at t
         slope (x) ② sample (x) - sample (x-1)

BEGIN
high_peak ② TRUE if and only if: slope(t) < 0 AND slope(t-1) > 0
low_peak  ② TRUE if and only if: slope(t) > 0 AND slope(t-1) < 0
curvature ② |slope(t) - slope(t-1)|
IF NOT high_peak AND NOT low_peak
   peak ② NONE
ELSE IF  |sample| ② < MIN_SAMPLE_FOR_PEAK
   peak ② weak
ELSE IF curvature < MIN_CURVATURE_FOR_PEAK
   peak ② weak
ELSE
   peak ② STRONG

END
```

*FIG. 7*

```
1      Define:  wave1 ② the wave segment from start to split:  wave(start, split)
2               wave2 ② the wave segment from split to current:  wave(split, current)
3               length(wave(x,y)) ② t_y - t_x
4               sample(peak) ② the sample value in the wave corresponding to current
5      BEGIN
6      match_found ② FALSE
7      FOR ALL (start, split) SUCH THAT
8      (MIN_WAVELENGTH ≤ length(wave1) < MAX_WAVELENGTH)
9   AND (MIN_WAVELENGTH ≤ length(wave2) < MAX_WAVELENGTH)
10  AND | length(wave1) - length(wave2) | / length(wave1) ≤ MAX_LENGTH_RATIO
11  AND | sample(start) - sample(split) | ≤ MAX_AMPLITUDE_DIFFERENCE
12  AND | sample(split) - sample(current) | ≤ MAX_AMPLITUDE_DIFFERENCE)
    {
13    difference ② compare(wave1, wave2)
14    IF (note_on AND (difference < MAX_DIFFERENCE_WHEN_NOTE_ON))
15       OR (NOT note_on AND (difference < MAX_DIFFERENCE_WHEN_NOTE_OFF)) {
16          wavelength = (length(wave1) + length(wave2)) / 2
17          IF (wavelength  2 * best_wavelength)
18             EXIT
19          IF (NOT match_found) OR (difference < best_match) {
20             best_match ② difference
21             best_wavelength ② wavelength
22             match_found ② TRUE
            }
         }
    }
23  END
```

*FIG. 8*

```
Compare(wave1, wave2)

BEGIN
  N_checkpoints ② length(wave1) / N_SAMPLES_PER_CHECKPOINT
  wavelength_ratio ② length(wave2) / length(wave1)

  difference ② 0
  i ② 0
  WHILE (i < N_checkpoints) {
      t1 ② t_start + i * N_SAMPLES_PER_CHECKPOINT
      t2 ② t_split + i * N_SAMPLES_PER_CHECKPOINT * wavelength_ratio

      s1 ② sample(t1)
      s2 ② sample(t2)
      difference ② difference + | s1 - s2 |
      mean_magnitude ② ( | s1 | + | s2 | ) / 2
      IF (mean_magnitude > mean_magnitude_max)
      mean_magnitude_max ② mean_magnitude

      i ② i + i
  }
  difference ② difference / (N_checkpoints * mean_magnitude_max)
  return(difference)
END
```

*FIG. 9*

```
    Frequency Calculation and Correction Routine

1   BEGIN

2   time_span ② t - time_of_last_match
3   suggested_frequency ② 1 / wavelength

4   IF suggested_frequency > last frequency THEN
5       frequency_change ② (suggested_frequency / last frequency)-1
6   ELSE
7       frequency_change ② (last frequency / suggested_frequency)-1
8   IF no match was found
9       frequency ② last frequency
10  ELSE {
11      time_of_last_match ② t
12      IF (frequency_change / time_span) < MAX_VOICE_SPEED THEN
13          frequency ② suggested_frequency
14      ELSE
15          frequency ② last frequency
    }
16  END
```

*FIG. 10*

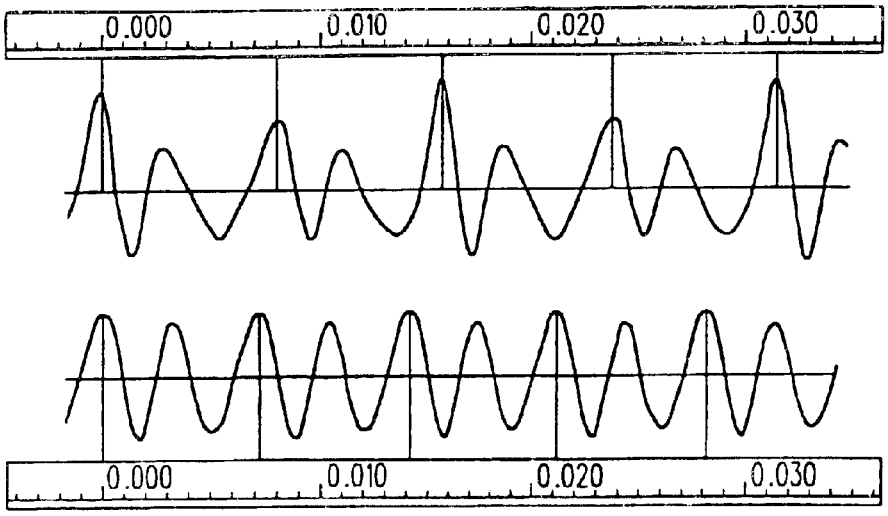

*FIG. 11*

```
Play and Attack Decision Module

Define:  t - the current time

BEGIN

IF   ( frequency reliability is GOOD or STABLE
     AND  there has been a recent loudness surge
     AND  (t - time_of_last_attack) < MIN_ATTACK_GAP
     )
  OR ( frequency reliability is STABLE
     AND current loudness > MIN_ATTACK_LOUDNESS
     AND note is OFF
     AND (t - time_of_play_off) > MIN_TIME_OFF
     )
THEN {
    note                    ② ON
    attack                  ② TRUE
    loudness surge          ② FALSE
    time_of_last_attack     ② t
}
ELSE {
    attack ② FALSE
    IF (frequency reliability is BAD) OR (loudness < MIN_LOUDNESS)
THEN {
      note                  ② OFF
      time_of_play_off      ② t
    }
}

END
```

*FIG. 14*

```
    Estimate Frequency Reliability

1   BEGIN

2     IF peak quality is WEAK THEN {
3        consecutive_weak ② consecutive_weak + 1
4        IF (consecutive_weak > MAX_CONSECUTIVE_WEAK)  THEN {
5           bad_frequency_signs ② bad_frequency signs + 1
6           good_frequency_signs ② 0
7           consecutive_weak ② 0
         }
      }
8     ELSE IF no frequency match was found THEN {
9           bad_frequency_signs ② bad_frequency signs + 1
10          good_frequency_signs ② 0
11          consecutive_weak ② 0
      }
12    ELSE {
        // frequency match was found
13      good_frequency_signs ② good_frequency_signs + 1
14      bad_frequency_signs ② 0
15      consecutive_weak ② 0
      }
16    IF (bad_frequency_signs > 5)  THEN
17       frequency reliability is BAD
18    ELSE IF (good_frequency_signs > 3)  THEN
19       frequency reliability is STABLE
20    ELSE IF (peak quality is STRONG AND a frequency match was found) THEN
21       frequency reliability is GOOD
22    ELSE
23       frequency reliability is UNSURE

24  END
```

*FIG. 15*

```
1   BEGIN

2   pitch ② pitch − synthesizer_offset + 12 * octave
3   IF continuous THEN
4     mode ② chromatic
5   nearest_note ② nearest_mode_note(pitch, mode, new_tonic)

6   IF NOT attack AND note_on THEN
7      pitch_difference ② pitch − current_note
8      IF continuous THEN
9         IF| pitch_difference | > MAX_BEND_RANGE
10             attack ② TRUE
       }
11     ELSE IF (nearest_note ? current_note) THEN
12        IF | pitch_difference | > |nearest_note − current_note| *
    MAX_PITCH_ERROR
13             attack ② TRUE

14  IF attack THEN
15     current_volume ②volume
16     current_note ② nearest_note
17     IF SG is currently playing THEN
18        send SG message: stop play
19     send SG message: play current_note at current_volume

20     IF continuous THEN
21        adjust_pitch (pitch − current_note)

22     time_of_last_change ② t
       }
23  ELSE IF SG is currently playing THEN {
24     IF note is OFF THEN {
25        send SG message: stop play
       }
26     ELSE IF (t − time_of_last_change > SG_REFRACTORY_PERIOD) THEN {
27        IF NOT (volume  current_volume) THEN {
28           current_volume ② volume
29           send SG message: set volume to current_volume
30           time_of_last_change ② t
          }
31        IF (continuous AND pitch_difference ? 0) THEN {
32           adjust_pitch(current_note, pitch_difference)
33           time_of_last_change ② t
          }

       }
34  END
```

*FIG. 17*

```
    nearest_mode_note(pitch, mode, new_tonic)

1   Define: Major:      {0,2,4,5,7,9,11,12}
2           Minor:      {0,2,3,5,7,8,11,12}
3           Blues:      {0,3,5,6,7,10,12}
4           Chromatic:  {0,1,2,3,4,5,6,7,8,9,10,11,12}

5   BEGIN

6   IF new_tonic THEN
7       tonic     round(pitch) modulo 12
8   offset        (pitch - tonic + 12) modulo 12
9   mode_note     value in specified mode nearest to offset
10  correction    mode_note - offset

11  return(pitch + correction)

13  END
```

*FIG. 18*

```
CFindPitch::CFindPitch()
{
    int i;
    I_peak=0;
    I_buffer=0;
    I_tic=0;
    Play_note-0;
    Loudness=0;
    T_tic-0;
    Freq=0;
    N_bad_freqs=0;

    Curvature_threshhold=((double) CURVE_THRESHHOLD) *22000.0/((double) SAMPLE_RATE);

    Max_freq_decay_factor=T_DEL_OCTAVE_REDUCTION_MIN*double(SAMPLE_RATE);
    Max_freq_decay_factor=pow(2.0-1.0/Max_freq_decay_factor);

    int n_code_points_per_highest_freq_wave=5;//# of code points for 360 deg of highest freq.

    T_peak=   new int[PEAK_FEATURE_BUFFER_SIZE];
    Goodness_peak=  new int[PEAK_FEATURE_BUFFER_SIZE];
    Ampl_peak=  new double[PEAK_FEATURE_BUFFER_SIZE];
    Ampl_peak_mag=  new double[PEAK_FEATURE_BUFFER_SIZE];
    Freq_peak_buffer=new double[PEAK_FEATURE_BUFFER_SIZE];

    T_loudness_tic = new int[PEAK_FEATURE_BUFFER_SIZE];
    T_peak_long_time_counter = new int[PEAK_FEATURE_BUFFER_SIZE];
    Loudness_time_buffer = new double[PEAK_FEATURE_BUFFER_SIZE];

    for(i=0; i < PEAK_FEATURE_BUFFER_SIZE; i++){
        Ampl_peak[i] = Ampl_peak_mag[i] = 0;
        T_peak[i] = 0
        Goodness_peak[i] = -1;
        Freq_peak_buffer[i] = 0;
        T_loudness_tic[i] = 0;
        T_peak_long_time_counter[i] = 0;
        Loudness_time_buffer[i] = 0;
    }
```

*FIG. 19*

```
37
38    int freq_lowest_expected = 50;
39    int freq_highest_expected = 400;
40
41    Time_ratio_error_consecutive_wavelengths_reject = 0.12;
42    N_points_raw_sound_buffer = (2*SAMPLE_RATE)(freq_lowest_expected;
43    N_samples_longest_expected_wavelength - int(1.05*double(SAMPLE_RATE)/ double(freq_lowest_expected));
44    int n_samples_per_wave_length_hi_freq = int(double(SAMPLE_RATE)/double (freq_highest_expected));
45    N_samples_shortest_expected_wavelength=int(0.97* double(n_sample_per_wave_length_hi_freq));
46
47    int n_code_points_per_wave_lo_freq=
48          n_code_points_per_highest_freq_wave*freq_highest_expected/freq_lowest_ expected + 20;
49    N_samples_per_code_point=
50          n_samples_per_wave_length_hi_freq/n_code_points_per_highest_freq_wave;
51
52    Ampl_buffer-new double[N_points_raw_sound_buffer];
53    for(i=0; i < N_points_raw_sound_buffer;i++)Ampl_buffer[i] = 0
54
55    Code_vector=  new double[n_code_points_per_wave_lo_freq];
56    Code_vector_previous = new double[n_code_points_per_wave_lo_freq];
57    Freq_half_note_divider = new double[50];
58
59    int  n_order = 3;
60    int  n_passes = 1;
61    double freq_low = 200;
62    double freq_high = 300; C62
63
64    Hof = new DHighOrdFilt();
65    Hof->Initialize(n_order, n_passes, freq_low, freq_high);
66    Filter_scale_factor = 2.0*pow(3.5, ((double) n_order));
  }
```

*FIG. 20*

```
void CfindPitch::GetPitch(double &freq, double &loudness, double ampl_raw,
            double &ampl_filt, int &got_new_freq, int &play_note,
                    int &got_note_attack, int &note)
        {
    1       int i,j;
    2       int i_peak_last, i_peak_last_last;
    3       int t_del, t_del_last, t_del_prev;
    4       Double rating, freq_orig;
    5       Static int note_last=0;
    6       Static double freq_last=0;
    7       Static double slope_last=0;
    8       int corrected_the_freq=0;
    9       Static int n_steps_skip_loudness_buf=0;
   10       Freq=Freq;
   11       Play_note = Play_note;
   12       Loudness = Loudness;
   13       t_del_prev = 1000000;
   14       Rating_min - 100.0;
   15       int wavelength_best=0;
   16       int t_del_prev_match=0, t_del_last_prev_match=0;
   17       int n_potential_matches = 0;
   18
   19       Ampl_filt=HOF->Filter(ampl_raw);
   20       Got_note_attack = 0;//for record keeping only
   21
   22       int i_buffer_last = I_buffer;
   23       T_tic = Mod_time_counter(T_tic + 1);
   24       I_buffer = Mod_sound_buffer(I_buffer + 1);
   25       Ampl_buffer[I_buffer]=ampl_filt;
   26
   27       Double slope = ampl_filt - Ampl_buffer[I_buffer_last];
   28
   29       int got_peak = (slope < 0) && (slope_last > 0);
   30       int got_valley = (slope > 0)&&(slope_last < 0);
   31       int got_extremem = got_valley || got_peak;
   32
   33       Double curvature = fabs(slope - slope_last);
   34
   35       Slope_last = slope;
   36
   37       int got_strong_extremem = got_extremem&&(ampl_filt > 10.0)
   38                                          &&(curvature > CURVE_THRESHOLD);
   39       if(!got_extremem){
   40             goto out_for;
   41       }
```

FIG. 21

GetPitch() continued □.

```
42  //-------------we are at a PEAK or Valley-------------
43  got_new_freq=1;
44  i_peak_last=I_peak;
45  I_peak=Mod_peaks(I_peak + 1);
46  T_peak[I_peak] = I_buffer;
47  T_peak_long_time_counter[I_peak] = T_tic;
48  Ampl_peak[I_peak] = ampl_filt;
49  Goodness_peak[I_peak] = -1;
50  Freq = freq = Freq_peak_buffer[I_peak] = Freq_peak_buffer[i_peak_last];
51  T_tic_last_good_pitch = T_tic;
52
53
54  if(!got_strong_extremum){
55      Goodness_peak[I_peak] = 0
56      goto out_far;
57  }
58  got_new_freq = 1;
59
60  for(i = -1; i>-15; i--){
61      i_peak_last - Mod_peaks(I_peak + 1);
62      t_del=Mod_sound_buffer(T_peak[I_peak]-T_peak[i_peak_last]);
63
64      if(t_del>N_samples_longest_expected_wavelength){
65          got out_near; //peak too far away: we couldn't get a match
66      }
67      else if(t_del<N_samples_shortest_expected_wavelength){
68          continue; //peak too far away: we couldn't get a match
69      }
70      for(j=i-1; j>i-15; j--){
71          i_peak_last_last=Mod_peaks(I_peak+j);
72          t_del_last=Mod_sound_buffer(T_peak[i_peak_last]-T_peak[i_peak_last_last] )
73
74          if(t_del_last>N_samples_longest_expected_wavelength){
75                  break;
76          }
77          if(t_del_last>N_samples_shortest_expected_wavelength){
78                  continue;
79          }
80          rating = Code_match(I_peak, i_peak_last, i-Peak_last_last);
81
82          if((!Play_note&& rating > RATE_LIMIT_LO)
83                              ||(Play_note&& rating > RATE_LIMIT_HI)){
84                  continue;
85          }
```

FIG. 22

GetPitch() continued □.

```
86          n_potential_matches++;
87          if(n_potential_matches==1){
88              Rating_min = rating;
89              wavelength_best=t_del;
90              t_del_prev_match = t_del;
91              t_del_last_prev_match = t_del_last;
92              if(rating < 0.50){
93                  goto out_near;
94              }
95              continue;
96          }
97          double time_diff_ratio =
98           (double) abs(t_del_last-t_del_prev_match-t_del_last_prev_match);
99
100         time_diff_ratio/=(double) t_del_last;
101
102         if(time_diff_ratio < 0.10){
103             goto out_near;
104         }
105         if(rating > Rating_min)
106             continue;
107         Rating_min = rating;
108         wavelength_best = t_del;
109         t_del_prev_match = t_del;
110         t_del_last_prev_match = t_del_last;
111         if(rating < 0.05){
112             goto out_near;
113         }
114
115     }
116 }
117 out_near:
118 if(n_potential_matches==0){
119     goto out_far;
120 }
121 Freq = freq = double(SAMPLE_RATE)/double(wavelength_best);
122 Goodness_peak[I_peak] = 1;
```

*FIG. 23*

```
                                        GetPitch() continued□.
122
123         Freq_orig = freq;
124         if(Correct_freq_doubling_or_halving_using_local_past(freq)){
125             corrected_the_freq = 1;
126         }
127         Freq = Freq_peak_buffer[l_peak] = freq;
128
129         N_peaks_since_got_good_freq = 0;
130         if(CONVERT_TO_HALF_TONES){
131             freq = find_nearest_half_note(freq, note);
132         }
133
134 out_for:
135         Static int got_note_decay;
136         if(got_extremum){
137             Loudness = loudness = Get_loudness(ampl_filt, freq);
138         }
139         If(++n_steps_skip_loudness_buf==N_STEPS_SKIP_LOUDNESS_BUF){
140             l_tic = Mod_loudness_tics(l_tic + 1);
141             Loudness_time_buffer[l_tic] = Loudness;
142             T_loudness_tic[l_tic] = T_tic;
143             n_steps_skip_loudness_buf = 0;
144         }
145         if(got_extremum){
146             int got_note_attack-with_new_freq;
147             Get_attack_and_play_condition(got_note_attack, got_strong_extremum,
148                                                 got_note_attack_with_new_freq);
149             if(corrected_the_freq){
150                 if(got_note_attack_with_new_freq){
151                     Freq_peak_buffer[l_peak] = Freq = freq_orig;
152                 }
153             }
154         }
155         play_note = Play_note;
    }
```

*FIG. 24*

```
double CFindPitch::Code_match(int i_peak, int i_peak_last, int i_peak_last_last)
{
    if(fabs(Ampl_peak[i_peak]-Ampl_peak[i_peak_last])
      >MAX_EXPECTED_CONSECUTIVE_PEAK_HEIGHT_DIFFERENCE){
          return 100;

    if(fabs(Ampl_peak[i_peak]-Ampl_peak[i_peak_last_last])
      >MAX_EXPECTED_CONSECUTIVE_PEAK_HEIGHT_DIFFERENCE){
          return 100;
    }
    int_peak = T_peak[i_peak];
    int t_peak_last  =T_peak[i_peak_last];
    int t_peak_last_last = T_peak[i_peak_last_last];

    int t_del=  Mod_sound_buffer(t_peak  -t_peak_last);
    int t_del_last = Mod_sound_buffer(t_peak_last-t_peak_last_last);

    double time_del_ratio-fabs(((double)(t_del-t_del_last))/((double)t_del)) ;

    if(fabs(time_del_ratio)>Time_ratio_error_consecutive_wavelengths_reject) ;
        return 200;
    }
    int i;
    int n_code_points = t_del/N_samples_per_code_point;
    double n_samples_per_code_point
            = double(t_del)/double(n_code_points);
    double n_samples_per_code_point_last
            = double(t_del_last)/double(n_code_points);

```

*FIG. 25*

Code_match() continued □

```
27
28    double dist;
29    double time_back=0, time_back_last=0;
30    int time  =t_peak;
31    int time_last=t_peak_last;
32
33    double distance = 0.0;
34    double ampl=0, ampl_max=-100.0;
35
36    for(i=0; i<n_code_points; i++){
37        Dist = fabs(Ampl_buffer[time] - Ampl_buffer[time_last];
38        Ampl = (fabs(Ampl_buffer[time]) + fabs(Ampl_buffer[time_last]));
39
40        if(ampl>ampl_max)
41            ampl_max = ampl;
42
43        Distance +=dist;
44        Time_back +=n_samples_per_code_point;
45        Time_back_last +=n_samples_per_code_point_last;
46
47        Time  =Mod_sound_buffer(t_peak  -round(time_back));
48        Time_last=Mod_sound_buffer(t_peak_last-round(time_back_last));
49    }
50    Distance=2.0*distance/(double(n_code_points)*ampl_max);
51    return distance;
    }
```

*FIG. 26*

```
int CfindPitch::Correct_freq_doubling_or_halving_using_local_past(double & freq)
{
    int i;
    int i_peak_prev;
    double freq_prev;
    int n_peaks_look_back = 4;

    for(i=1; i<=n_peaks_look_back; i++){
        i_peak_prev=Mod_peaks(I_peak-1);

    freq_prev = Freq_peak_buffer[i_peak_prev];

    if(freq_prev==0)
        return 0; //only at the VERY beginning

    if(Goodness_peak[i_peak_prev]<=0)
        continue;
    if(fabs(freq_prev-freq) > 40){
        Freq = freq = freq_prev;
        return 1;
    }
  }
  return 0;
}
```

*FIG. 27*

```
double CFindPitch::Get_loudness(double ampl_filt, double freq)
{
    int t_del;
    double wave_length;
    int time_stretch_look_in_the_past;
    int t_del_for_max_peak=0;
    int i_peak_prev, i;
    static double loudness_rate =  0;
    static double loudness_target =  0;
    double stretch_factor;

    static int play_note_=0;
    double ampl_filt_mag = fabs(ampl_filt);
    if(freq==0){
        //only at the very beginning
        time_stretch_look_in_the_past = N_samples_longest_expected_wavelength;
    }
    else{
        wave_length = SAMPLE_RATE/freq;
        stretch_factor - pow(Max_freq_decay_factor,
                double(Mod_time_counter(T_tic-T_tic_last_good_pitch)));
        time_stretch_look_in_the_past = round(stretch_factor*wave_length);
        time_stretch_look_in_the_past = imin(N_samples_longest_expected_wavelength,
                                                time_stretch_look_in_the_past);
    }
    //This for-loop finds the largest (plus) peak over the
    //most recent(time_stretch_look_in_the_past)samples;
    double ampl_max=ampl_filt_mag, ap;
    int t_peak_current = T_peak[I_peak];

    for(i=1; i<10; i++){
        i_peak_prev=Mod_peaks(I_peak-i);
        t_del=Mod_sound_buffer(t_peak_current-T_peak[i_peak_prev]);
        if(t_del>time_stretch_look_in_the_past)
            break;
        ap=fabs(Ampl_peak[i_peak_prev]);
        if(ap>ampl_max){
            ampl_max=ap;
            t_del_for_max_peak=t_del;
        }
    }
    Return Loudness=ampl_max;
}
```

*FIG. 28*

*FIG. 29*

```
int CFindPitch::Check_for_loudness_attack()
{
    static double LOUDNESS_RATIO_ATTACK_ACCEPT = 0.65;
    static int T_DEL_ATTACK_REFRACTION=int(double(SAMPLE_RATE)*0.1); //0.1 secs
    static int N_CONSECUTIVE_LOW_TICS_REQUIRED = 2;
    int i, n_tics_low=0, i_last=0;
    int i_tic_look_back, t_del_from_now_till_I_tic_prev;
    double ampl_min = 100000;

    static int t_loudness_attack_refraction_over=-1;

    double loudness_low_accept=
          LOUDNESS_RATIO_ATTACK_ACCEPT*Loudness_time_buffer[I_tic];
    int t_tic_look_back;

    static int t_tic_last_attack=-1;
    int t_tic_current = T_loudness_tic[I_tic];

    if(t_tic_current<t_loudness_attack_refraction_over){
          Return 0;
    }
    if(Loudness_time_buffer[I_tic]<LOUDNESS_MIN_REQUIRED_FOR_LOUDNESS_ATTACK
          Return 0;

    for(i=1;i<PEAK_FEATURE_BUFFER_SIZE; i++){
          i_tic_look_back = Mod_peaks(I_tic-i);
          t_del_from_now_till_i_tic_prev=
                Mod_time_counter(t_tic_current-T_loudness_tic[i_tic_look_back];

          if(t_del_from_now_till_i_tic_prev>N_STEPS_LOOK_BACK_ATTACK)
                break;

          if(Loudness_time_buffer[i_tic_look_back]<loudness_low_accept){
                if((i-i_last)>1){
                      n_tics_low=1;
                      t_tic_look_back=T_loudness_tic[i_tic_look_back];
                      if(t_tic_look_back==t_tic_last_attack){
                            return 0;
                      }
                }
                else{
                      n_tics_low++;
                      if(n_tics_low>=N_CONSECUTIVE_LOW_TICS_REQUIRED){
                            t_tic_last_attack=t_tic_current;
                            t_loudness_attack_refraction_over=
                                  Mod_time_counter(t_tic_current + T_DEL_ATTACK_REFRACTION);
                            return 1;
                      }
                }
                i_last=i;
          }
    }
    return 0;
}
```

```
int CFindPitch::Get_goodness_of_the_frequency()
{
        int i;
        static int T_DEL_WITH_BAD_FREQS_FOR_NOTE_TURN_OFF = int(double(SAMPLE_RATE)*0.05);
        static int N_PEAKS_IN_PAST_WITH_GOOD_FREQ_FOR_HALFWAY_GOOD_FREQ=1;
        static int N_GOOD_PEAKS_IN_PAST_WITH_GOOD_FREQ_TO_HAVE_REALLY_GOOD_FREQ= 3;
        int goodness_peak_prev;
        int i_peak_prev, t_del;
        for(i=0; i<100; i++){
                i_peak_prev=MOd_peaks(I_peak-1);
                t_del=Mod_time_counter(T_peak_long_time_counter[I_peak]
                                -T_peak_long_time_counter[i_peak_prev];
                if(t_del>T_DEL_WITH_BAD_FREQS_FOR_NOTE_TURN_OFF)
                        return-1;
                if(Goodness_peak[i_peak_prev]>0)
                        break;
        }
        if(Goodness_peak[I_peak]<0)
                return 0;

        int n_consecutive_bad_curvature_excess=0;
        if(Freq_peak_buffer[I_peak]<150)
                n_consecutive_bad_curvature_excess=7;
        else if(Freq_peak_buffer[I_peak]<200)
                n_consecutive_bad_curvature_excess=6;
        else if(Freq_peak_buffer[I_peak]<250)
                n_consecutive_bad_curvature_excess=5;

        int n_consecutive_bad_curvature=0, n_good=0;
        const static int T_DEL_MAX_LOOK_BACK_FOR_VERY_GOOD_FREQ
                                =int(double(SAMPLE_RATE)*0.2);//0.2 seconds

        for(i=0; i<100; i++){
                i_peak_prev=Mod_peaks(I_peak-i);
                t_del=Mod_time_counter(T_peak_long_time_counter[I_peak]
                        -T_peak_long_time_counter[i_peak_prev]);
                if(t_Del>T_DEL_MAX_LOOK_BACK_FOR_VERY_GOOD_FREQ)
                        return 0;
```

*FIG. 30*

```
38          Get_goodness_of_the_frequency() continued □ □

39          goodness_peak_prev = Goodness_peak[i_peak_prev];
40
41          if(     goodness_peak_prev==0){
42                  if(++n_consecutive_bad_curvature>n_consecutive_bad_curvature_excess)
43                          break;
44          }
45          else if(goodness_peak_prev==1){
46                  if(++n_good==
                        N_GOOD_PEAKS_WITH_GOOD_FREQ_TO_HAVE_REALLY_GOOD_FREQ)
47                          return 2;
48                  n_consecutive_bad_curvature=0;
49          }
50          else break;
51      }
52      if(Goodness_peak[I_peak]==1)
53              return 1;
54      return 0;
    }
```

*FIG. 31*

```
void CFindPitch::Get_attack_and_play_condition(int&got_attack,
                                               int got_strong_extremum,
                                               int&got_note_attack_with_new_freq)
{
  static int i_count_down_refraction = 0;
  static int got_loudness_decay = 0;
  static int freq_goodness =-1;
  int got_loudness_attack = 0;
  const static int TIME_SINCE_PLAY_OFF_MIN_FOR_VERY_GOOD_FREQ_ATTACK
                          =int(double(SAMPLE_RATE)*0.05);
  const static double LOUDNESS_THRESHHOLD_FOR_VERY_GOOD_FREQ_ATTACK =;10.0

  static int time_of_play_off=-1;
  int time_since_play_off;
  got_note_attack_with_new_freq =got_note_attack = 0

  int freq_goodness_prev=freq_goodness;
  freq_goodness=Get_goodness_of_the_frequency();

  if(got_strong_extremum){
      got_loudness_attack = 0
      if(freq_goodness>0){
          got_loudness_attack=Check_for_loudness_attack();
          if(got_loudness_attack){
              got_note_attack=1;
              Play_note=1;
              got_loudness_decay=0;
              if(freq_goodness_prev<=0)//note this
                  got_note_attack_with_new_freq=1;
          }
      }
  }
  if(!got_note_attack&&!Play_note&&freq_goodness>1){

      time_since_play_off=Mod_time_counter(T_tic-time_of_play_off);

      if(time_since_play_off>TIME_SINCE_PLAY_OFF_MIN_FOR_VERY_GOOD_FREQ_ATTACK){
          if(Loudness>LOUDNESS_THRESHHOLD_FOR_VERY_GOOD_FREQ_ATTACK){
              if(PRINT_OVERVIEW)
                  fprintf(opo,"Got attack(very good freq)!!\m"
              got_note_attack=1;
              Play_note=1;
              got_loudness_decay=0;
          }
      }
  }
  if(Loudness<VOLUME_THRESHHOLD||freq_goodness<0){
      Play_note=0;
      freq_goodness=-1;
      time_of_play_off=T_tic;
  }
}
```

*FIG. 32*

VOICE CONTROLLED ELECTRONIC MUSICAL INSTRUMENT

This application claims benefit of provisional application No. 60/135,014 filed May 20, 1999.

BACKGROUND OF THE INVENTION

1. Technical Field

The invention relates to musical instruments. More particularly, the invention relates to a voice-controlled electronic musical instrument.

2. Description of the Prior Art

Musical instruments have traditionally been difficult to play, thus requiring a significant investment of time and, in some cases money, to learn the basic operating skills of that instrument. In addition to frequent and often arduous practice sessions, music lessons would typically be required, teaching the mechanical skills to achieve the proper musical expression associated with that instrument, such as pitch, loudness, and timbre. In addition, a musical language would be taught so that the user would be able to operate the instrument to play previously written songs.

The evolution of musical instruments has been relatively slow, with few new musical-instrument products taking hold over the past several hundred years. The introduction of electronics-related technology, however, has had a significant impact on musical-instrument product development. The music synthesizer, for example, together with the piano keyboard interface/controller, has vastly expanded the number and variety of instrument sounds which can be produced by a person who has learned to play a single instrument—that of piano or keyboards. The requirement remained, however, that for someone to operate a synthesizer, that person would have to learn at least some of the fundamentals of music expression associated with playing a piano.

Therefore, for those people who wanted to be able to express themselves musically, but had not learned to play an instrument, or wanted to be able to make many instrument sounds without learning how to play each instrument, there was still a significant time investment required to learn the skill, with no assurance that they could ever reach a level of proficiency acceptable to them.

In U.S. Pat. Nos. 3,484,530 and 3,634,596, there are disclosed systems for producing musical outputs from a memory containing recorded musical notes that can be stimulated by single note inputs through a microphone. The systems disclosed in these patents are reportedly able to detect pitch, attack, sustain, and decay as well as volume level and are able to apply these sensed inputs to the recorded note being played back. In effect, the systems are musical note to musical note converters that may be converted fast enough so that no lag can be detected by the listener or by the player. However, to achieve these capabilities, rather cumbersome and expensive electronic and mechanical means were suggested, which are not suited for portable or handheld instruments, but primarily intended for larger systems.

In the systems disclosed in the above patents, the memory is capable of containing discrete notes of the chromatic scale and respond to discrete input notes of the same pitch. The system is analogous to a keyboard instrument where the player has only discrete notes to choose from and actuates one by depressing that particular key. Other musical instruments give a player a choice of pitches between whole and half tone increments. For example, a violin can produce a pitch which is variable depending upon where the string is fretted or a slide trombone can cause a pitch falling in between whole and half tone increments. Both of these instruments produce an unbroken frequency spectrum of pitch. However, such prior art systems are not able to provide a continually varying pitch at the output in response to a continually varying pitch at the input, nor have they been able to produce a note timbre that realistically duplicates what a real instrument does as a function of pitch over the range of the instrument nor provide a note quality or timbre which realistically duplicates what a real instrument does as a function of degree of force at the input of an instrument.

A variety of other methods have been proposed to use the human voice to control a synthesizer, thus taking advantage of the singular musical expression mechanism which most people have. Virtually anyone who can speak has the ability to change musically expressive parameters such as pitch and loudness. One such method is described in R. Rupert, U.S. Pat. No. 4,463,650 (Aug. 7, 1984). In the Rupert device, real instrumental notes are contained in a memory with the system responsive to the stimuli of, what he refers to as 'mouth music' to create playable musical instruments that responds to the mouth music stimuli in real time. See, also, K. Obata, Input apparatus of electronic device for extracting pitch from input waveform signal, U.S. Patent No. 4,924,746 (May 15, 1990).

Ishikawa, Sakata, Obara, Voice Recognition Interval Scoring System, European Pat. No. 142,935 (May 29, 1985), recognizing the inaccuracies of the singing voice "contemplates providing correcting means for easily correcting interval data scored and to correct the interval in a correcting mode by shifting cursors at portions to be corrected." In a similar attempt to deal with vocal inaccuracies, a device described by M. Tsunoo et al, U.S. Pat. No. 3,999,456 (Dec. 28, 1976) uses a voice keying system for a voice-controlled musical instrument which limits the output tone to a musical scale. The difficulty in employing either the Ishikawa or the Tsunoo devices for useful purposes is that most untrained musicians do not know which scales are appropriate for different songs and applications. The device may even be a detractor from the unimproved voice-controlled music synthesizer, due to the frustration of the user not being able to reach certain notes he desires to play.

In a related area, the concept of "music-minus-one" is the use of a predefined usually prerecorded musical background to supply contextual music around which a musician/user sings or plays an instrument, usually the lead part. This concept allows the user to make fuller sounding music, by playing a key part, but having the other parts played by other musicians. Benefits to such an experience include greater entertainment value, practice value and an outlet for creative expression.

M. Hoff, Entertainment and creative expression device for easily playing along to background music, U.S. Pat. No. 4,771,671 (Sep. 20, 1988) discloses an enhancement to the music minus-one concept, providing a degree of intelligence to the musical instrument playing the lead the voice-controlled music synthesizer, in this case so as not to produce a note which sounds dissonant or discordant relative to the background music. In addition, Hoff discloses a variation on the voice-controlled music synthesizer by employing correction. Rather than correcting the interval in an arbitrary manner, as suggested in the Tsunoo and Ishikawa patents, this device adjusts the output of the music synthesizer to one which necessarily sounds good to the average listener, relative to predefined background music.

However, Hoff performs pitch correction only in the context of pre-programmed accompaniments, using the scale note suggested by the accompaniment nearest to the detected pitch. Hoff does not provide pitch correction in the absence of accompaniment, for example, the capability for the user to choose the scale to be used for the pitch correction or the capability to assign the currently detected pitch to the tonic of that scale.

Various approaches to the process of pitch detection itself are known. For example, see M. Russ, *Sound Synthesis and Sampling*, Focal Press, 1996, p. 265, or L. Rabiner et. al., *A Comparative Performance Study of Several Pitch Detection Algorithms*, IEEE Transactions on Acoustics, Speech, and Signal Processing, Vol. ASSP-24, No. 5, October 1976, p. 399. According to Russ, the traditional general classifications for pitch detection are a) zero-crossing, b) auto-correlation, c) spectral interpretation. Two auto-correlation approaches that bear some resemblance to the present approach are example, S. Dame, Method and Device For Determining The Primary Pitch of A Music Signal, U.S. Pat. No. 5,619,004 (8 Apr. 1997) and M. J. Ross, H. L. Shaffer, A. Cohen, R. Freudberg, and H. J. Manley, *Average Magnitude Difference Function Pitch Extractor*, IEEE Trans. on Acoustics, Speech, and Signal Processing, Vol. ASSP-22, No. 5 (October 1974).

A major drawback of all presently known systems that allow voice control of a musical instrument is that they require bulky enclosures and are presented in unfamiliar form factors, i.e. as imposing pieces of technical equipment. Thus, a user is unable to connect with such instruments in a natural way. Rather than playing a musical instrument, such devices give one the impression of operating a piece of machinery which, in most cases, is similar to operating a computer. This fact alone well explains the lack of commercial success and consumer acceptance these devices have found.

It would be advantageous to provide a voice-controlled musical instrument in a form factor that most nearly represents the actual instrument that the electronic instrument is to represent. It would be further advantageous if such form factor contributed to the ease of use of such instrument by providing a user with a simple method of operation. It would also be advantageous to provide a computationally efficient pitch detection technique for a voice-controlled electronic musical instrument, such that a reduced size form factor could be achieved.

SUMMARY OF THE INVENTION

The invention provides a voice-controlled musical instrument in a form factor that most nearly represents the actual instrument that the electronic instrument is to represent. Such form factor contributes to the ease of use of such instrument by providing a user with a simple method of operation. The invention also provides a computationally efficient pitch-detection technique for a voice-controlled electronic musical instrument.

The device described in this document is an electronic, voice-controlled musical instrument. It is in essence an electronic kazoo. The player hums into the mouthpiece, and the device imitates the sound of a musical instrument whose pitch and volume change in response to the player's voice.

The player is given the impression of playing the actual instrument and controlling it intimately with the fine nuances of his voice. Significantly, the device is compact, self contained, and operated by the user with a simple set of controls. In such way, the invention overcomes many of the barriers to acceptance of such electronic instruments as were taught in the prior art. That is, the device is simple to operate and to hold while playing. Because the device is self contained, lightweight, and fully integrated, there are no exposed wires or connections to make between various components of a system which would detract from both the enjoyment of the device and the sense that the device is an electronic surrogate for the actual instrument that it physically represents. Because the device is provided in a dedicated form, e.g. as a horn, the user is drawn into the musical experience rather than distracted by the use of a microphone. Thus, voice operation of the device most nearly implies playing the actual instrument the device represents and creates the impression that the user is actually playing an instrument. Further, by taking the counterintuitive measure of severely restricting the user's ability to alter operation of the device, the user interface is significantly simplified. This again imposes the form and operation of the actual instrument onto the device, such that the user may feel as though he is playing the instrument, even though he may not have the musical skill to operate the actual instrument. Because the device uses a unique pitch-detection scheme that is both computationally efficient and well suited for an integrated device, such as the voice-controlled electronic musical instrument herein disclosed, it is possible to provide both a compact, self-contained device and, significantly, a device that provides a high degree of musicality, thereby further enhancing the impression that the user is actually playing a musical instrument.

The instrument can in principle be any music-producing sound source: a trumpet, trombone, saxophone, oboe, bassoon, clarinet, flute, piano, electric guitar, voice, whistle, i.e. virtually any source of sound.

In its simplest configuration, the instrument resembles a kind of horn, and is for convenience called the HumHorn throughout this document. However, the shape and appearance of the instrument can be fashioned by the manufacturer to match the sound of any traditional instrument, if desired; or its shape can be completely novel. The functional requirements of the HumHorn's physical design are only:

- That it be hand-held;
- That it have a mouthpiece—where the player's voice enters;
- That it have one or more speakers—where the sound is produced; and
- That it have a body—where the electronics and batteries are stored and where finger-actuated controls can be placed.

Three primary software components of the HumHorn are the frequency-detection module, the loudness-tracking module, and the note-attack module.

The frequency-detection module (FDM) identifies the frequency of the player's voice. It does this by analyzing the incoming sound wave and finding patterns of recurring shapes. This method is a highly computationally efficient and novel combination of auto-correlation and zero-crossing- or peak-based pitch detection. The chosen instrument is synthesized at the pitch determined by the FDM or at an offset from that pitch as desired by the player.

The loudness-tracking component measures the loudness of the player's voice, and this information is used then to set the volume of the synthesized sound.

The note-attack module detects abrupt changes in the loudness of the player's voice. This component helps decide when the synthesized instrument should begin a new note.

BRIEF DESCRIPTION OF THE DRAWINGS

FIG. 7 is a pseudo code listing showing a test to determine whether a current sample is a peak according to the invention;

FIG. 8 is a pseudo code listing for a routine that iterates over different wave segments according to the invention;

FIG. 9 is a pseudo code listing for a routine that compares two wave segments according to the invention;

FIG. 10 is a pseudo code listing for a routine that calculates and corrects the frequency according to the invention;

FIG. 11 is a waveform showing two ambiguous waves;

FIG. 14 is a pseudo code listing for a play and attack decision module according to the invention;

FIG. 15 is a pseudo code listing for a routine for estimating frequency reliability according to the invention;

FIG. 17 is a pseudo code listing for a message processor according to the invention;

FIG. 18 is a pseudo code listing for a routine to find the nearest note in a specified mode according to the invention;

FIG. 19 is a C++ code listing for a first portion of a constructor for a GetPtich class according to the invention;

FIG. 20 is a C++ code listing for a second portion of the constructor for a GetPitch class according to the invention;

FIG. 21 is a C++ code listing for a first portion of a GetPitch routine according to the invention;

FIG. 22 is a C++ code listing for second portion of the GetPitch routine according to the invention;

FIG. 23 is a C++ code listing for third portion of the GetPitch routine according to the invention;

FIG. 24 is a C++ code listing for fourth portion of the GetPitch routine according to the invention;

FIG. 25 is a C++ code listing for a first portion of a Code_match routine according to the invention;

FIG. 26 is a C++ code listing for second portion of the Code_match routine according to the invention;

FIG. 27 is a C++ code listing for a frequency correction routine according to the invention;

FIG. 28 is a C++ code listing for a loudness tracking routine according to the invention;

FIG. 29 is a C++ code listing for a loudness attack detection routine according to the invention;

FIG. 30 is a C++ code listing for a first portion of a frequency "goodness" estimation routine according to the invention;

FIG. 31 is a C++ code listing for the second portion of the frequency "goodness" estimation routine according to the invention;

FIG. 32 is a C++ code listing for an attack and play condition routine according to the invention.

DETAILED DESCRIPTION OF THE INVENTION

Glossary

Figure 1:
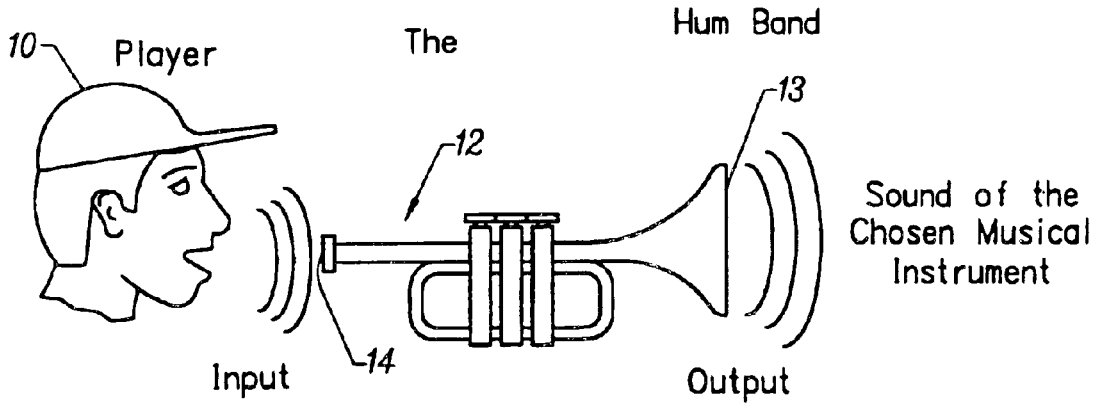
FIG. 1 is a schematic representation of a voice-controlled electronic musical instrument according to the invention.

For purposes of the discussion herein, the following terms have the following meaning:

ADC: Analog to digital converter, converts analog voltages to digital samples.

Amplitude:

1) When referring to a point in the signal, it is the distance of that point from the centerline. If the centerline is zero, as it is assumed to be throughout this document, then the amplitude is the absolute value of the sample at that point.
2) When referring to a wave or wave segment, it is the absolute value of the sample furthest from the centerline.

Attack: The beginning part or onset of a note.

DAC: Digital to analog converter, converts digital sample values to analog voltages.

F, F(t): see fundamental frequency.

Filtered signal (filtered sample): The input signal (input sample) after it has passed through the band-pass filter. In this document, all signals and samples are assumed to be filtered unless explicitly stated.

Fundamental frequency, F(t): The frequency of the lowest pitch present in the signal. It is the frequency recognizable as the pitch being sung or hummed.

Fundamental wave: Any wave in the signal whose length is the fundamental wavelength. It is the longest repeated wave.

Fundamental wave shape: The longest indivisible, repeated wave shape

Fundamental wavelength, W(t): The length (in time) of the longest repeating wave in the input. It corresponds to the perceived pitch of the input signal at a given time step and is the inverse of the fundamental frequency: i.e., $W(t)=1/F(t)$.

Half-step: Same as semitone.

L, L(t), Loudness: The volume of the input signal, this value corresponds to the perceptual notion of volume or loudness. It is difficult to describe mathematically, as it is a mixture of several factors. It is most closely related to the amplitude of a wave, but also to some extent related to the frequencies contained within the wave. In this document, loudness always refers to the input signal received from the player. See volume.

Loudness surge: A sudden increase in the loudness of the player's voice. It is a good indication that the player wants the instrument to produce an attack.

MIDI: The Musical Instrument Digital Interface, a standard protocol used for digital communication between musical instruments and computers. It is used by nearly all electronic keyboards and digital music synthesis systems.

Mode, Musical mode: A set of semitones, drawn from the set of all eleven possible semitones in an octave, that musicians use to characterize notes in a section of music.

Examples are: major mode, minor mode, blues mode, and many more esoteric modes, such as dorian, phrygian, whole-tone, pentatonic, etc.

Note:

1) The sound of a tone played by an instrument. A note begins with an attack, which is followed by a sustained period and then a decay.

2) A discrete, integer-valued pitch; i.e. the index of an integer-valued pitch on a linear musical scale, such as a musical staff or piano keyboard, where an interval of 1 in the scale corresponds to a half-step. Thus, two notes an octave apart will be separated in the scale by a difference of 12. See pitch.

Note attack: The beginning part or onset of a note.

Perceived pitch: Most sounds, including those made by voices and musical instruments, are composed of many different frequencies and have many overlapping pitches. Generally, the human ear perceives two different musical sounds as equivalent when they share the same lowest (or fundamental) frequency; i.e. they appear to have the same pitch, regardless of all other frequencies present.

Pitch: The position of an auditory frequency on a linear musical scale, such as a musical staff or a piano keyboard, where two pitches an octave apart are separated by a constant number of steps, e.g. 12. In contrast, two frequencies an octave apart have a fixed ratio, i.e. 2. The linear scale of pitch is more natural to human understanding than the logarithmic scale of frequencies. In this document, pitch is understood to be a continuous value that can fall anywhere on the musical scale. A note, on the other hand, is a discrete, integer value.

R: see sample rate.

SAM: The Signal Analysis Module, which analyzes the input signal one sample at a time and outputs pitch, volume, and attack values, as well as a value indicating whether or not a note should be playing.

Sample rate, sampling rate: Denoted R, the frequency at which the ADC (or DAC) converts analog voltages to digital samples (or digital samples to analog voltages). Common sampling rates for auditory signals are 8,000 Hz, 11,025 Hz, 22,050 Hz, 44,100 Hz, and 48,000 Hz; the higher the sampling rate, the higher the fidelity. Unless otherwise indicated, "sample rate" and "sampling rate" refer to the sampling of the input signal.

Sample, sample(t), s(t), sample value: A time-indexed digitally coded value representing the height of the signal wave at one moment in time. Input samples are passed to the SAM by the ADC. The input sample at time step t is denoted s(t). Output samples are passed from the SSM to the DAC. Unless otherwise stated, "sample" refers to the input sample.

Sampling: The process of converting an input signal to a series of digitally coded numbers. This process is performed by the ADC.

Semitone: One half step, the smallest interval used in standard western-European music. It is the interval between adjacent keys on a piano and between adjacent notes on a musical staff. There are twelve evenly spaced semitones in an octave. Two tones that are one semitone apart therefore have a frequency ratio of $2^{1/12}$.

Signal: A sequence of analog values that change over time. An auditory signal looks, when plotted on a graph, like a wave. At every moment in time, the input signal has a certain value that can be converted to a digital number that represents the voltage of the signal at that point. The process of conversion is called sampling. It is performed by the ADC. Similarly, an output signal is produced by the DAC when it receives a series over time of digitally coded samples. Unless otherwise indicated, "signal" refers to the input signal.

Strong peak: A peak in the input signal that meets the STRONG peak criteria of box 61 in FIG. 6. See accompanying text.

Volume: In this document, volume always refers to how loud the output signal produced by the HumHorn is. See loudness.

W, W(t): see fundamental wavelength.

Wave shape: The contour, including the size, number, and position of the peaks and valleys in a given wave segment.

Wavelength: The length of time between the beginning of a wave and the beginning of the following wave. It is the inverse of the frequency.

Weak peak: A peak in the input signal that meets the WEAK peak criteria of box 61 in FIG. 6. See accompanying text.

Discussion

The invention provides a voice-controlled musical instrument in a form factor that most nearly represents the actual instrument that the electronic instrument is to represent. Such form factor contributes to the ease of use of such instrument by providing a user with a simple method of operation. The invention also provides a computationally efficient pitch-detection technique for a voice-controlled electronic musical instrument.

The device described in this document is an electronic, voice-controlled musical instrument. It is in essence an electronic kazoo. The player hums into the mouthpiece, and the device imitates the sound of a musical instrument whose pitch and volume change in response to the player's voice.

The player is given the impression of playing the actual instrument and controlling it intimately with the fine nuances of his voice. Significantly, the device is compact, self contained, and operated by the user with a simple set of controls. In such way, the invention overcomes many of the barriers to acceptance of such electronic instruments as were taught in the prior an.

That is, the device is simple to operate and to hold while playing. Because the device is self contained, lightweight, and fully integrated, there are no exposed wires or connections to make between various components of a system which would detract from both the enjoyment of the device and the sense that the device is an electronic surrogate for the actual instrument that it physically represents. Because the device is provided in a dedicated form, e.g. as a horn, the user is drawn into the musical experience rather than distracted by the use of a microphone. Thus, voice operation of the device most nearly implies playing the actual instrument the device represents and creates the impression that the user is actually playing an instrument. Further, by taking the counter intuitive measure of severely restricting the user's ability to alter operation of the device, the user interface is significantly simplified. This again imposes the form and operation of the actual instrument onto the device, such that the user may feel as though he is playing the instrument, even though he may not have the musical skill to operate the actual instrument. Because the device uses a unique pitch-detection scheme that is both computationally efficient and well suited for an integrated device, such as the voice-controlled electronic musical instrument herein disclosed, it is possible to provide both a compact, self-contained device and, significantly, a device that provides a high degree of musicality, thereby further enhancing the impression that the user is actually playing a musical instrument.

Key aspects of the invention include:

Portability—because it is compact and self contained, the instrument herein disclosed can be easily transported while being played or not, for example in a marching band.

Accessibility—because of its simple interface, the instrument disclosed herein can be used by the physically handicapped, e.g. partially or fully paralyzed individuals.

Simulated musical proficiency—this describes the act of playing the instrument.

The HumHorn imitates the experience of playing and performing an actual musical instrument, including the visual, tactile, and auditory qualities of the experience, and including the finely nuanced auditory control of an instrument that previously only musicians trained in the art of a musical instrument could have, and also including all the personal, psychological, and social benefits that accompany the act of performing an actual musical instrument, whether solo or together with other performers, whether in front of an audience or alone."

The instrument can in principle be any music-producing sound source: a trumpet, trombone, clarinet, flute, piano, electric guitar, voice, whistle, even a chorus of voices, i.e. virtually any source of sound.

In its simplest configuration, the instrument resembles a kind of horn, and is for convenience called the HumHorn throughout this document. However, the shape and appearance of the instrument can be fashioned by the manufacturer to match the sound of any traditional instrument, if desired; or its shape can be completely novel. The functional requirements of the HumHorn's physical design are only:

That it be hand-held;

That it have a mouthpiece—where the player's voice enters;

That it have one or more speakers—where the sound is produced; and

That it have a body—where the electronics and batteries are stored and where finger-actuated controls can be placed.

Three primary software components of the HumHorn are the frequency-detection module, the loudness-tracking module, and the note-attack module.

The frequency-detection module (FDM) identifies the frequency of the player's voice. It does this by analyzing the incoming sound wave and finding patterns of recurring shapes. This method is a highly computationally efficient and novel combination of auto-correlation and zero-crossing- or peak-based pitch detection. The chosen instrument is synthesized at the pitch determined by the FDM or at an offset from that pitch as desired by the player. Various approaches to the process of pitch detection itself are known. As discussed above, Russ discloses that the traditional general classifications for pitch detection are a) zero-crossing, b) auto-correlation, c) spectral interpretation. However, the present approach is much more computationally efficient because the wave shapes are compared (correlated) only for time spans bounded by distinguishing wave characteristics such as peaks or zero crossings rather than to spans bounded by arbitrary sample points. For the latter case, a much greater number of correlation calculations are required. The present approach simply takes advantage of the fact that waves can be segmented by distinguishing characteristics such as peaks or zero crossings. In terms of Russ' classifications, the present approach is a novel combination of (a) and (b) classifications, providing the accuracy of auto-correlation with the computational efficiency of the zero crossing methods. Furthermore, as an improvement over auto-correlation, the present approach accounts for pitch change over time by stretching or shrinking the compared waves to the same length before correlation is performed.

The loudness-tracking component measures the loudness of the player's voice, and this information is used then to set the volume of the synthesized sound.

The note-attack module detects abrupt changes in the loudness of the player's voice. This component helps decide when the synthesized instrument should begin a new note.

The HumHorn is a hand-held music synthesizer whose output is controlled by the human voice. FIG. 1 diagrams the functionality of the HumHorn. The player 10 sings or hums into the mouthpiece 14 of the instrument 12. In response, the HumHorn produces the sound at the output 13 of a musical instrument that closely follows in both pitch and volume the nuances of the player's voice. The player can choose which instrument the HumHorn should imitate, and is given the impression of playing the chosen instrument merely by singing.

Key to the invention is the fact that the form factor of the device is a musical instrument and that all components of the device are contained within the instrument itself. In this way, the user is most nearly given the impression of playing an actual instrument and not of operating a computer or other electronic device. It is thought that this fact alone is sufficiently significant to overcome the technophobia that intimidates many individuals when they are confronted with new technologies. Thus, by placing the invention within a familiar enclosure, e.g. a horn or other well known musical instrument, a psychological barrier is overcome that allows the device to be used by a broader group of persons. Additionally, because it is small, lightweight, compact, and simple to operate, a physical barrier is overcome, allowing physically disabled individuals the ability to play a musical instrument. Further, by providing a musical instrument metaphor, the user and audience are given the impression that an actual instrument is actually being played. This means that the sounds produced by the device match the instrument it resembles, as is expected by the user.

Figure 2:
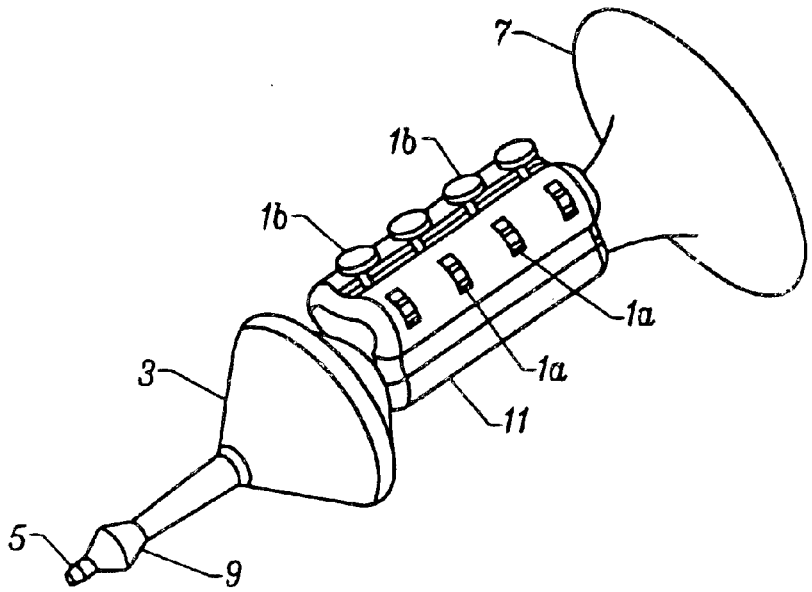
FIG. 2 is a is a more detailed schematic representation of a voice-controlled electronic musical instrument according to the invention.

The HumHorn itself can resemble any known or novel instrument. One possible configuration is shown in FIG. 2. In this model, the mouthpiece 5 leads directly to the microphone 9. The loudspeaker resides in a double-cone section 3 from which a channel leads through the central housing 11 to a bell section 7 where the sound is transmitted. Thus, the housing imparts an acoustic quality to the sound produced. The electronics and batteries are contained in the central housing, which also holds several finger-actuated controls: both push buttons 1*b* and selection switches 1*a*. These controls allow the player to alter synthesizer parameters, such as instrument selection, volume, or octave.

Figure 3:
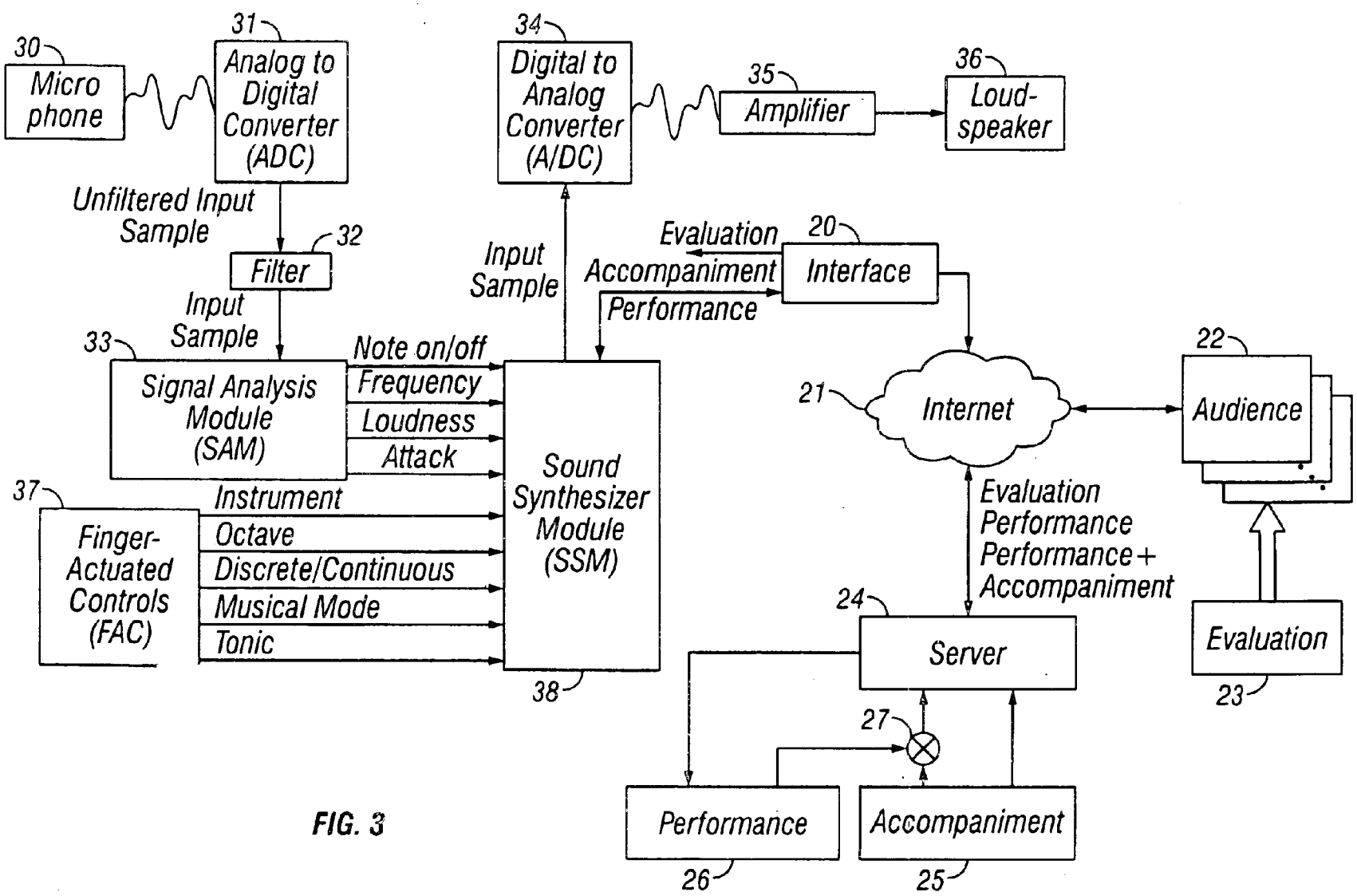
FIG. 3 is a block diagram showing the components of a voice-controlled musical instrument according to the invention.

The logical structure of the HumHorn is diagrammed in FIG. 3. The microphone 30 sends an analog signal to an analog-to-digital converter (ADC) 31, which samples the signal at a fixed frequency, preferably 22,050 Hz. The ADC converts one sample at a time and sends it to a band-pass filter 32 (which smoothes the signal by removing frequencies that are too high or too low). Each filtered sample is then sent to the signal-analysis module (SAM) 33 where it is analyzed within the context of the preceding samples. After analyzing the sample, the SAM passes the following information to the synthesizer 38:

Whether the synthesizer should be playing a note or not, and if so:

The current frequency,

The current volume (loudness); and

Whether the conditions for a new note attack have been detected.

Besides this information from the SAM, the synthesizer also receives input from the finger-actuated controls 37. These control values can modify a variety of synthesizer parameters, including (but not limited to):

The current instrument (sound source) to imitate;

The offset from the player's voice, i.e. whether to play the synthesized note at the same pitch as it is sung, or to play it at a specified interval above or below this pitch;

Whether the synthesizer should always play the exact frequency detected by the SAM (continuous pitch tracking) or instead play the nearest note to that frequency in a specified musical mode (discrete pitch tracking);

The musical mode to use for discrete pitch tracking, e.g. chromatic, major, minor, blues; and Whether the current pitch is the tonic (first note) in the given musical mode.

An output sample is then produced by the synthesizer according to all information passed in, and this output sample is fed to a digital-to-analog converter (DAC) 34. The DAC produces an analog output signal from a stream of digital output samples that it receives. This signal is sent to an amplifier 35 before being transmitted by the loudspeaker 36.

The remainder of this document provides a detailed discussion of the components outlined above. The software components (those from FIG. 3) are described first. Hardware components are described second.

Software Components

The discussion below first describes the filter. Next, the discussion describes the core software component, the SAM, which consists of three sub-modules: the frequency-detection module (FDM), the play and attack decision module (PADM), and the loudness-tracking module (LTM). Thereafter, the discussion describes the sound synthesizer module (SSM).

The Filter

The filter takes the raw input signal directly from the ADC and digitally filters it, one sample at a time. The digital filter is allowed to look at previous samples, but it cannot see future values. The filter smoothes the raw data, removing jagged peaks, which are usually not related to the player's intended pitch. A simple third-order band-pass filter is used. The filter has a low cutoff of 200 Hz and a high cutoff of 300 Hz. A preferred filter is described in W. Press, B. Flannery, S. Teukolsky, W. Vetterling, *Numerical Recipes in C*, pp. 456–460, Cambridge University Press (1988). From this point on, all references to the signal, to sample values, and to waves always refer to the filtered values, and all graphs display filtered values. The raw, unfiltered values are assumed to be inaccessible. Thus, if the digital filter were to be replaced with analog circuitry, the remainder of this document would not need to be changed.

The Signal-analysis Module (SAM)

Figure 4:
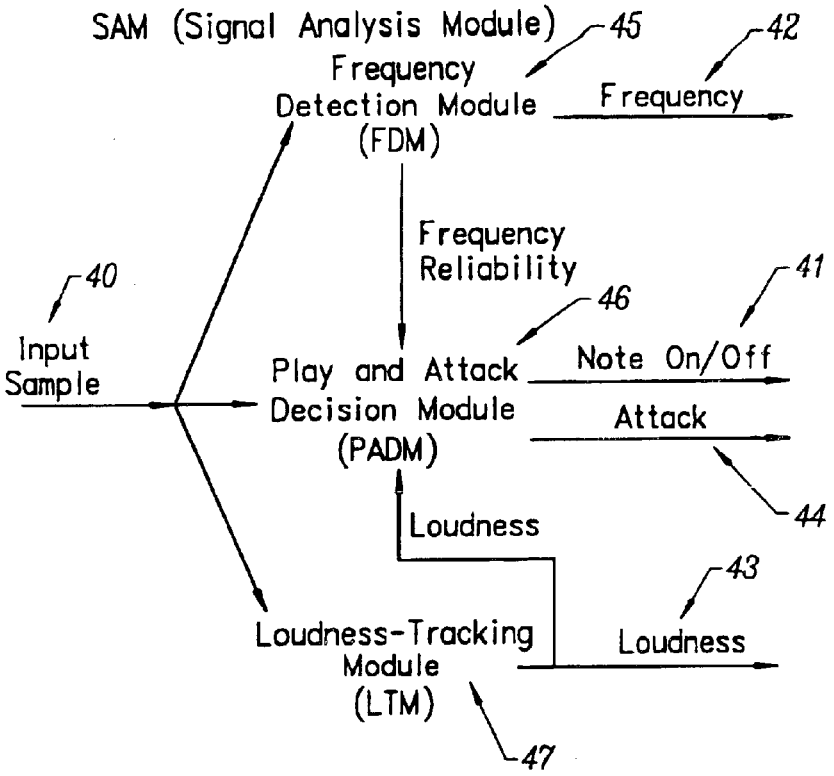
FIG. 4 is a process flow showing a signal analysis module according to the invention.

The signal-analysis module (SAM) takes the current sample as input 40 and produces as output the four pieces of information described above: note on/off 41, frequency 42, loudness 43, and attack 44. The relationship between SAM's three sub-modules is diagrammed in FIG. 4. The input sample is available to all three sub-modules. The FDM 45 calculates both the frequency of the input signal as well as a measure of this calculation's reliability. The former is sent on to the SSM 38 (FIG. 3), while the latter is used by the PADM 46. The PADM also makes use of the loudness value computed by the LTM 47. These components and their relationships are described in the following sections.

The Frequency-detection Modul (FDM)

The frequency-detection module (FDM) analyzes the input signal to discover the fundamental frequency. It does this by looking for patterns in the shapes of the incoming waves. The fundamental wavelength is the largest repeated shape.

Figure 5:
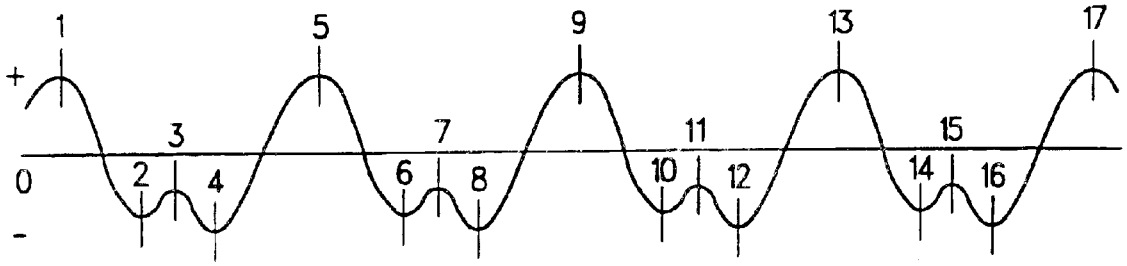
FIG. 5 is a waveform showing an example of an input signal.

FIG. 5 displays a wave resembling one that a human voice might produce after band-pass filtering. The horizontal axis represents time; points on the right occur after points on the left. The vertical axis represents signal voltage. Points above the center horizontal line have a positive voltage. Points below this line have a negative voltage. The ADC converts these voltages to digital sample values. With the preferred 8-bit ADC, the sample values fall within the range ±128 (a 16-bit ADC generates values in the range ±32768.) The greater the average magnitude of a wave's samples, the louder it is.

The peaks are given labels, 1–17, representing the order in which they occur. The term peak is used to refer to both high (odd numbered) as well as low (even numbered) peaks. The time at which a peak occurs is written $t_p$, where p is the number of the peak, e.g. the time at which peak 1 occurred is written $t_1$, etc. The wave stretches from $t_1$ to $t_{17}$ and consists of a fundamental wave repeated four times: $t_1$ to $t_5$, $t_5$ to $t_9$, $t_9$ to $t_{13}$, and $t_{13}$ to $t_{17}$. The duration or length of this wave (e.g. $t_{13}-t_9$) is the fundamental wavelength and is inversely proportional to the fundamental frequency $$F(t)=1/W(t) \tag{1}$$

where W(t) is the fundamental wavelength and F(t) is the fundamental frequency. The FDM finds this fundamental wavelength by finding the longest indivisible, repeated wave shape—the fundamental wave shape. It is indivisible if it is not itself composed entirely of a repeated wave shape. For example, in FIG. 5 the wave shape from $t_{13}$ to $t_{17}$ matches that from $t_9$ to $t_{13}$ and is the fundamental wave shape. Although the segment from $t_9$ to $t_{17}$ matches the segment from $t_1$ to $t_9$, it is not the fundamental wave shape because it is divisible into the two smaller matching segments.

This technique—identifying the fundamental frequency by finding the fundamental wave shape—works for the HumHorn because the input signal is the human voice, and certain properties of this input signal are known in advance. First, the voice can only produce a certain range of frequencies and wavelengths. Therefore, waves longer or shorter than this range can be ignored, which keeps the processing effort within reasonable bounds. Second, the human voice can be effectively band-pass filtered, and the resulting waveform is smooth and well behaved (see below). In this context, a well-behaved wave is one where the fundamental wave spans only a small number of peaks—typically not more than four or five. This also helps limit the search effort.

The FDM finds the fundamental wave shape by comparing recent segments of the input wave in search of the largest repeated shape. The efficiency of the FDM's shape-matching method is due to one fundamental insight: because the fundamental wave shape is always bounded by peaks, the search for matching wave shapes can be greatly economized by comparing only wave segments bounded by peaks. For this reason, frequency calculations are only performed when a new peak is detected. Because the fundamental wave usually has no more than four or five peaks, the number of comparisons is generally not more than about 25 (as will be seen shortly), and the average is much less than this.

Figure 6:
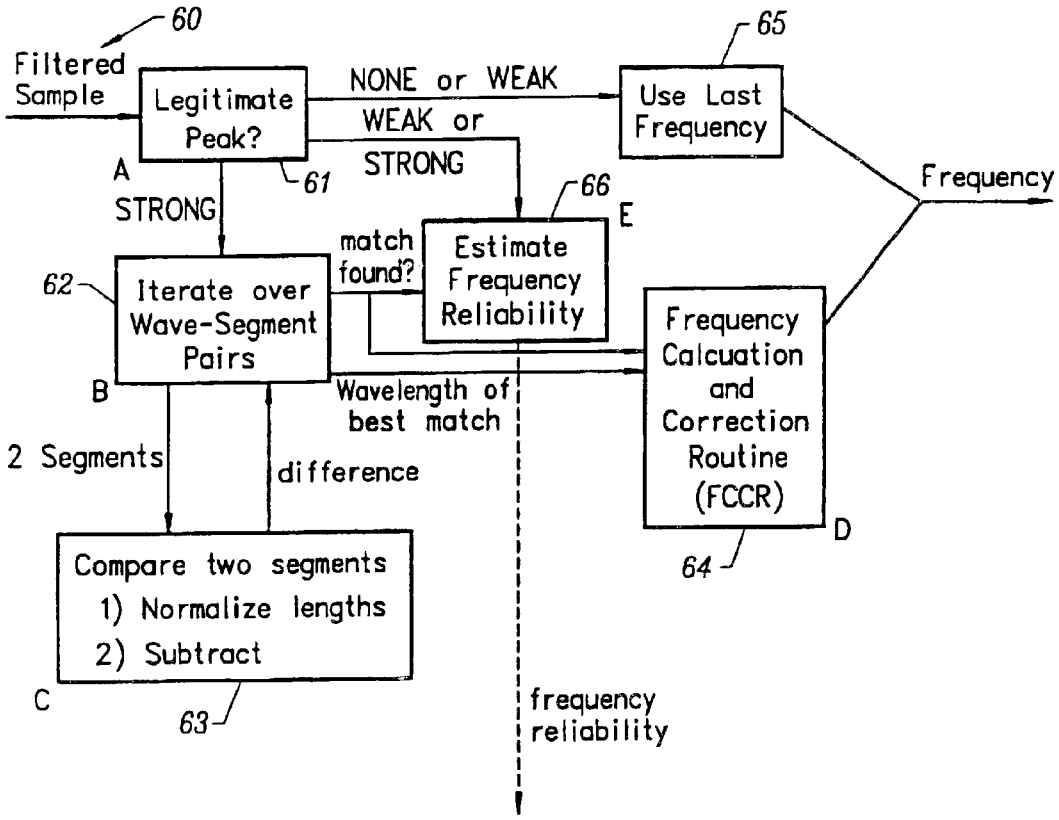
FIG. 6 is a block diagram showing the components of a frequency-detection module according to the invention.

The entire process of frequency detection is represented in FIG. 6. With every new sample 60 a test is performed to see whether this sample clearly represents a new peak 61. If not, the frequency is left unchanged from its previous value 65. However, if the sample does clearly represent a new peak, a search is performed over recent previous peaks to find wave segments whose shapes might match each other 62. If none are found, then the frequency is again left unchanged 65. If there are possible matches, they are compared in more detail 63 and the best match is used to compute the new frequency 64.

Test for Peak

The box numbered 61 in FIG. 6 tests whether the current sample represents a peak. The test measures the first and second derivative of the wave at the current point. There are three possible outcomes: STRONG, WEAK, and NONE. Pseudo code for this test is shown in FIG. 7. Lines 1 through 3 define t to be the current time, sample(t) to be the value of the input sample at the current time step, and slope(t) to measure the slope at the current time step. There are two kinds of peaks: high peaks (those that curve down—line 5) and low peaks (those that curve up—line 6). The curvature is set equal to the magnitude of the second derivative at the sample point (line 7). The vertical bars "| |" represent absolute value. If the sample is neither a high peak nor a low peak, then there is no peak (line 8, 9). If the sample magnitude is less than a threshold (line 10) or the magnitude of the second derivative is too low (line 12), then the peak exists, but is weak (line 11 or 13). Otherwise,the point is a strong peak (line 15). A wave-shape search is only performed when there is a strong peak.

Note that the test in line 10 only serves to reduce the number of peaks used for frequency estimation (strong peaks), and hence reduce the overall computational burden. This particular method for culling the peaks is rather arbitrary. The test of line 10 could be removed altogether to increase the rate of frequency estimation at the expense of added computation.

Iterate Over Individual Wave-segment Pairs

If the current sample is a strong peak, then the box numbered 62 in FIG. 6 (iterate over individual wave-segment pairs) enumerates all pairs of recent wave segments and sends them to the box numbered 63 to be compared. As an example of what is done in box 62, refer again to FIG. 5. Suppose that the peak at $t_{17}$ has just been detected in box 61. It is now used as the endpoint for the second of two segments to be compared. The first segment, wave1, begins on a peak temporarily labeled start, and ends on a later peak temporarily labeled split. The second segment, wave2, begins on the split peak and ends on the peak just detected in box 61, called current. Initially, split is the penultimate peak and start is the immediately preceding peak. Then an iterative process begins, whereby the start and split labels are moved backwards in time from one peak to the next. Each time a label is moved, the new segments wave1 and wave2 are compared. This continues until all likely segments are compared. As was already stated, only wavelengths within a certain range need to be considered. Segments are first tested to see whether they are likely matches before they are sent to box 63 for comparison. The start and split peaks must also be strong peaks.

Referring again to FIG. 5, $t_{17}$ is current, and the wave segments shown in Table A below are processed.

TABLE A

| Wave Segments | | | |
|---|---|---|---|
| Wave 1 wave (start, split) | Wave 2 wave (split, current) | Wave 1 wave (start, split) | Wave 2 wave (split, current) |
| wave(15, 16) | wave(16, 17) | wave(13, 14) | wave(14, 17) |
| wave(14, 16) | wave(16, 17) | wave(12, 14) | wave(14, 17) |
| . . . | . . . | . . . | . . . |
| wave(8, 16) | wave(16, 17) | wave(6, 14) | wave(14, 17) |
| wave(14, 15) | wave(15, 17) | wave(8, 9) | wave(9, 17) |
| wave(13, 15) | wave(15, 17) | wave(7, 9) | wave(9, 17) |
| . . . | . . . | . . . | . . . |
| wave(7, 15) | wave(15, 17) | wave(1, 9) | wave(9, 17) |

The pseudo-code for box 62 is given in FIG. 8. In lines 1–4, wave1 and wave2 are defined as above; the length( ) function is defined to be the wavelength as given above; and the sample( ) function returns the value of the input sample at the given peak. Line 6 initializes a flag that records whether there was a match. Lines 7 through 12 iterate through all the wave segments that are reasonable candidates to match. The waves must be within the wavelengths that the human voice can produce (lines 8, 9). They must have approximately the same length (line 10). They must begin and end at approximately the same height on the graph (lines 11 and 12). If all these criteria have been met, then the waves are compared (line 13). The comparison procedure is described in detail in the following paragraph, but briefly stated, it stretches the waves to the same length and then subtracts one from the other. The difference resulting from this subtraction is used to judge their similarity: the closer the difference is to zero, the more similar the two waves are. If the two waves are similar enough (lines 14 and 15) then they are considered to have matched. The criterion for whether or not they match depends upon whether a note is currently playing. If a note is not playing, then a stricter standard is used, which ensures that playing begins at the correct frequency. Once a note has started playing and the approximate frequency has been established, a more relaxed standard is applied. These two different standards are needed due to the Frequency Calculation and Correction Module (FCCR): As is explained in more detail below, once a note has been established the FCCR forces each new frequency to be close to the previous one. It is therefore much more important to get the frequency right at the onset of the note.

If the segments do match, then the fundamental wavelength they represent (the average of their individual lengths) is calculated (line 16). If this wavelength is approximately twice that of the best wavelength matched so far (line 17), then the search has gone too far, and wave1 and wave2 each consist of two complete fundamental wave shapes. In this case, processing stops and the new frequency is returned (line 18). Otherwise, the difference between the segments is compared against previous difference values (line 19). If it is the lowest so far, it is kept (lines 20 and 21), and the match flag is set to TRUE.

Although the preferred frequency detection method described here relies on the identification of peaks, it could just as well rely on the identification of any other distinguishing characteristic, such as, for example, zero crossings. In the case of zero crossings, the analogue of a strong peak (in box 61) is a zero crossing with a large positive or negative slope.

Compare Two Wave Segments

Box 63, which compares two segments, takes two wave segments, stretches or shrinks the second one so that it is the same length as the first one, and adds up their sample differences. Instead of summing the differences over every sample in both waves, only a small number of evenly distributed samples (called checkpoints) are chosen, which speeds processing. The distance between each checkpoint is approximately N_SAMPLES_PER_CHECKPOINT. Pseudo-code for box 63 is shown in FIG. 9. The two wave segments are called wave1 and wave2. Line 2 calculates the number of checkpoints, based on the length of wave1. The floor symbol "⌊ ⌋" means to round down to the nearest integer. The value of wavelength_ratio represents the length of wave2 compared to the length of wave1 (line 3). The while loop on lines 5, 6, and 13 iterate through all the checkpoints. At line 7, $t_1$ is the time of the $I^{th}$ checkpoint in wave1. $t_2$ is the time of the $I^{th}$ checkpoint in wave2—which is based on $t_1$, but expanded or contracted to correspond to the same location in wave2. Lines 9 and 10 find the sample values for wave1 and wave2 at the $I^{th}$ checkpoint. In line 11, the difference between the two waves is updated with the magnitude of their difference at this checkpoint. In lines 12–14, the average magnitude of the two samples is calculated, and the maximum of this value is kept for the entire wave. At the end, in line 16, the sum of the wave's differences is normalized for both length and height so that the effect of the procedure is the same for both high and low frequencies, and both loud and soft signals.

The Frequency Calculation and Correction Routine (FCCR)

During the progress of a note, the frequency never changes drastically between consecutive peaks. The human voice simply cannot change frequency very much over such small time scales, and this fact can be used to provide a certain degree of frequency correction. If the current frequency is significantly different from the previously detected frequency, then either the former or the latter is in error. Though this situation could be handled in a variety of ways, the frequency calculation and correction routine (FCCR) (box 64 in FIG. 6) assumes that the most recently detected frequency is false and replaces it with the previously detected frequency. (It is especially for this reason that frequency detection is more stringent when a note is established than after the note has already begun, see FIG. 8, lines 14 and 15.) By accepting only small frequency changes in its input, the output of the HumHorn appears to change pitch smoothly and continuously.

The pseudo code for the FCCR is shown in FIG. 10. Line 2 calculates the time elapsed since the last wave match. Line 3 calculates what the frequency will be if the best wavelength is accepted, as according to Equation (1). Lines 4–7 calculate the percent difference in frequency between the last accepted frequency and the newly suggested one. The numerator is the larger of the two, and 1 is subtracted from the quotient for normalization. If no match was found in box 62, the frequency is left unchanged (line 9). Otherwise, its time is recorded (line 9) to be used again in a later iteration at line 2. If the change in frequency was within the speed that the human voice can achieve, then the frequency is changed to the new value, otherwise it is left unchanged.

An alternative approach to frequency correction is to allow only one significant frequency change during a note, but only if the match rating for the new frequency was very good, i.e. if difference in FIG. 8, line 13 is very low. This corrects a poorly started note by the singer, or an incorrectly detected note attack by the HumHorn.

Most errors in frequency detection are off by an octave. FIG. 11 shows two filtered waveforms recorded from the same voice. These waveforms are particularly interesting because they are so highly ambiguous and are a challenge for the frequency detector. The upper wave has a wavelength of just under eight milliseconds, but it could easily be interpreted as having a wavelength of twice this much due to shape replication. For the lower wave, the opposite is true. It has a wavelength of just over seven milliseconds, but it could easily be interpreted as having half this wavelength. For the FDM to recognize both wavelengths correctly the parameters must be carefully tuned. The full set of parameter values is discussed below.

Another method for correcting the frequency entails altering box 62 in FIG. 6. When the best match is too far from the previous wavelength, box 62 could return the match that was closest to the previous wavelength. It is possible that this wavelength, though not the best match, was the real fundamental wavelength.

Frequency correction is an important part of the frequency-detection process, and there are a multitude of different techniques for accomplishing it. In frequency correction, the general frequency-detection algorithm has reduced the number of candidate frequencies from the entire spectrum that the human voice can produce, down to a small number of alterative, typically two or three. In these cases, the ambiguity that may be difficult for the general-purpose frequency-detection algorithm to distinguish may be simpler for a special-purpose algorithm. Two methods in particular that can be used for these occasional frequency ambiguities are: (a) predictive filtering and other parametric frequency-estimation techniques, and (b) context-sensitive probabilistic methods. In the case of (a), these methods require a great deal of prior information about the wave and are therefore intractable for the general frequency-detection case, but they are accurate and efficient when the frequency candidates can be reduced to a small number, as in the frequency-correction scenario. In case (b), the context, i.e. the pitches the user has sung recently, can help to predict the probability that the singer will attempt to sing other pitches. These probabilities can be used together with the small number of candidates found by the frequency-detection algorithm to choose the most likely attempted pitch. For example, if the singer has in the last few notes been singing upwards in ascending semitones, then, given two ambiguous alternatives, one a semitone higher than the last pitch and the other one octave plus one semitone higher, the probability is greater that the former rather than the latter was intended by the singer. In general, a priori information about the human voice and the wave patterns that it can generate, or is likely to generate, can be used for making the final decision as to which frequency has been detected.

Estimate Frequency Reliability.

Box 66, estimate frequency reliability, is an important routine, but it is better described below when the context for its use becomes more clear. For now, it is noted that box 66 has not yet been described but that in the discussion below, when there is a need for a measurement of frequency reliability, box 66 is described and explained.

Remarks on the FDM

The entire frequency-detection procedure is not very computationally intensive, consisting mostly of summations over a small subset of recent time steps. Yet, this approach is very effective for finding the correct fundamental frequency. Most other methods for frequency detection rely on much more filtering of the signal. Spectral methods require several orders of magnitude more computation. The FDM is also much faster reacting than spectral methods, requiring far fewer samples before the fundamental wavelength is detected. The FDM method is related to standard auto-correlation, but it is less computationally intensive. Whereas auto-correlation methods use a dot product to measure wave-shape similarity, which involves a large number of multiplications, the FDM uses the sum of differences. The FDM also saves considerable computational effort by comparing only wave segments bounded by wave-shape features—such as peaks or zero crossings.

The Play and Attack Decision Module (PADM)

The sound of some instruments at the beginning of a note can be quite distinctive. For example, brass instruments usually have a punchy, breathy sound. This part of the note is called its attack. The frequency at which the note's attack occurs is called its attack frequency. In all, the HumHorn plays an attack in four different cases:

- When there has been an abrupt increase in loudness, accompanied or soon followed by a good frequency detection;
- When a note is not currently being played, but a good frequency has been detected for some minimum time;
- When pitch tracking is continuous and the pitch has moved beyond the range where the synthesizer can produce smooth pitch changes based on the attack pitch; and
- When pitch tracking is discrete, and the pitch has moved too far from the attack pitch and too close to another pitch in the selected musical mode.

The third and fourth of these cases involve performance and synthesizer options. These cases are handled by the SSM (the Sound Synthesizes Module) and are described in detail below. The first two cases require the detection of an intended attack on the part of the player. These cases are handled by the Play and Attack Detection Module (PADM).

As the player hums, he wants the HumHorn to produce an attack at specific times. The player automatically uses his tongue and lips, pronouncing consonants, usually 'd', 't', 'l', 'p', 'b', and/or 'm', to separate one note from the next. One generally sings syllables such as 'dum, ba dum, badumpadumpadum', or 'doodle oo, doodle oo, doodle oo doo doo,' to make notes distinct. By doing this, the player is intuitively signaling the HumHorn to produce an attack. The PADM can detect these signals and respond to them by issuing attacks to the SSM.

In both case (1) and case (2) above, if there is any doubt as to the frequency of the signal, no attack should be issued. Furthermore, in case (2) the player must have been singing a good frequency for some reasonable period. Therefore, as was mentioned above, a procedure is required for determining the reliability of the detected frequency. The frequency reliability information is passed in from box 66 of FIG. 6. This procedure returns one of four possible values:

| | |
|---|---|
| BAD: | The current frequency is unknown, and no reliable frequency has been detected recently. |
| UNSURE: | A frequency was recently detected, but not at the latest peak. |
| GOOD: | A frequency was detected at the latest peak, but there have been uncertainties in the recent past. |
| STABLE: | A frequency has been detected consistently over the recent past. |

Figure 13:
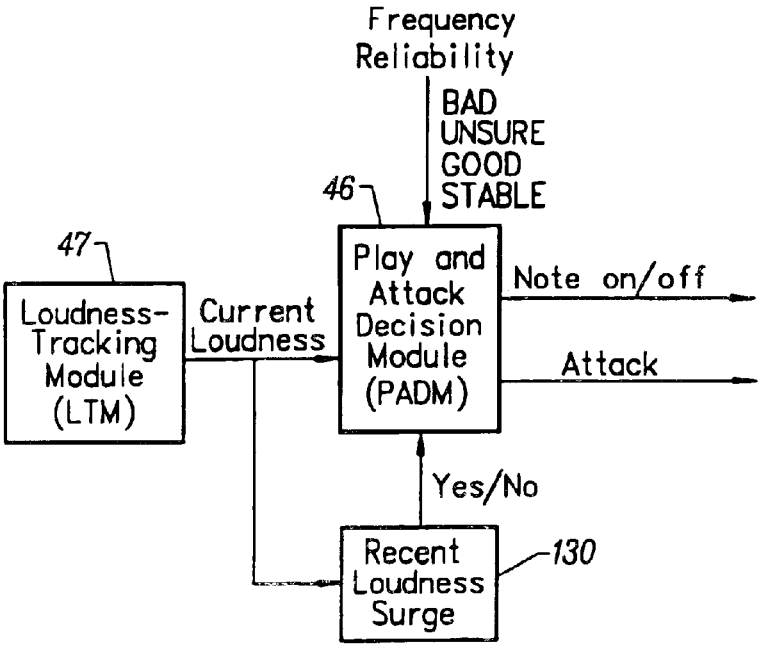
FIG. 13 is a play and attack decision module according to the invention.

The routine for calculating the frequency reliability is described below. First, though, the rest of the PADM is described. A diagram of the relationships between the PADM and its related routines is given in FIG. 13. Besides frequency reliability, the PADM 46 also requires information about the current loudness of the player's voice. The loudness is calculated by the LTM 47, the Loudness-Tracking Module, which is described below. The PADM also requires information about recent changes in loudness, in particular, whether the loudness has suddenly increased abruptly in the recent past. This information comes from the Recent Loudness Surge routine 130, which is described below.

Pseudo code for the PADM is given in FIG. 14. The PADM issues an attack in two different cases, corresponding to case (1) and case (2) above. Lines 3–5 correspond to case (1), and lines 7–10 correspond to case (2). In the first case, an attack is issued if: (line 3) there has recently been at least one frequency match (the frequency reliability is GOOD or STABLE); (line 4) there has been an abrupt increase in loudness; and (line 5) sufficient time has passed since the last attack. In the second case, the frequency reliability has been steady for some time (line 7), the signal is loud enough (line 8), no note is currently playing (line 9), and sufficient time has passed since the note was turned off (line 10). In both of these cases, flags are set to indicate that a note should now be playing (line 12) and that an attack should be issued (line 13). The time is recorded (line 15) for use in the next iteration at line 5. If neither case 1 nor case 2 holds, then there will be no attack issued (line 17). In addition, if there was also no match for the last peak, or the loudness has dropped to a low enough level (line 18), then play is turned off (line 19) and the time is recorded (line 20) for use in the next iteration at line 10.

Frequency Reliability Estimation

The following discussion concerns box 66 in FIG. 6, Estimate Frequency Reliability. It may be helpful to look back at FIG. 6 and the accompanying text for reference. Each peak is evaluated when it occurs, i.e. whenever a sample is at a STRONG or a WEAK peak. Weak peaks are relatively common. Though they are not used to initiate shape matching and frequency detection, they are nevertheless a helpful part of the shape-matching process because they provide vital information about the shape of the wave. When strong, matching peaks, i.e. peaks for which a match was found by the FDM, are separated by small numbers of weak peaks, then this is a good sign, and indicates a prolonged, stable signal at the detected frequency. However, if there are too many weak peaks in a row, then this is a bad sign. It indicates that the signal itself is weak or has been lost. A weak or lost signal is a normal part of detection. It happens most often when the player stops singing a note, or is separating two notes by pronouncing a consonant, which adds noise to the signal. Another bad sign, i.e. indication that the frequency has been lost, is when a strong peak is found but the FDM can find no shape match for it. Thus, the reliability of the signal can be rated according to good signs and bad signs. The good signs are strong, matching peaks. The bad signs are non-matching peaks and strings of too many weak peaks in a row. The frequency is STABLE if there have been at least three good signs in a row with no bad signs. It is BAD if there have been at least five bad signs in a row with no good signs. If neither BAD nor STABLE, but the current peak is a strong, matching peak, then the frequency reliability is GOOD. If none of these cases apply, then the reliability is UNSURE.

FIG. 15 shows the pseudo code for estimating frequency reliability. Lines 2–15 count the good signs and bad signs. Lines 16–23 classify them into a reliability estimate. If the current peak is weak (line 2), then the number of consecutive weak peaks is incremented (line 3). If the number of consecutive weak peaks is too large (a bad sign), then the bad-sign counter should be incremented (line 5) and the good-sign counter should be reset to zero (line 6). Also, the counting of consecutive weak peaks should begin again (line 7).

Otherwise, because the peak is not weak it must be strong (line 8). If no match was found (bad sign) then, again, the bad-sign counter is incremented (line 9), the good-sign counter is reset (line 10), and the weak-peaks counter is reset (line 11). However, if a match was found (good sign), then the good-sign counter is incremented (line 13), the bad-sign counter reset (line 14), and again, the weak-peaks counter is reset (line 15). At line 16 the classification begins. If, leading up to the current peak, there are have been five or more bad signs in a row, then the frequency reliability is BAD (line 17). If there have been three or more good signs, then the reliability is STABLE (line 19). If neither BAD nor STABLE, but the current peak is a strong, matching peak, then the reliability is GOOD (line 21). If none of these cases apply, then the reliability is UNSURE (line 23).

The numbers of good signs (3) and bad signs (5) are clearly arbitrary and a matter of tuning. The criteria for good signs and bad signs could also in principle be enhanced to include other indicators.

Loudness Surge Detection

The final component required by the PADM is the routine for detecting a recent loudness surge. This routine returns TRUE if there has recently been a loudness surge (a sudden increase in the loudness of the player's voice) that has not already been used as the basis for an attack. A loudness surge is considered to have occurred whenever the current loudness is substantially greater than any previous loudness in the recent past, i.e. when $$L(t)>\text{SURGE_RATIO}*\min(L(t-\text{WINDOW_SIZE}),\ldots,L(t-\epsilon)) \quad (2)$$

where L(t) is the current loudness, as calculated by one of the methods to be described below, SURGE_RATIO is the ratio by which the current loudness must exceed the earlier loudness, WINDOW_SIZE is the length of the "recent past", i.e. the maximum time for a loudness surge to take place, min( ) returns the minimum value of its arguments, and $\epsilon=1/R$, the time between samples, where R is the sample rate. When a loudness surge occurs, a flag is set and the time is recorded. The routine then returns TRUE for surge_time seconds, or until the flag is unset (FIG. 14 line 14).

The "min" function in Equation 0 is computationally expensive in comparison with the rest of the HumHorn's functions. One method that can speed this process is to split up the loudness values into bins, each of which represents a range of values. When a new loudness value arrives, the bin that it corresponds to is incremented. WINDOW_SIZE seconds later, when the value should leave the window, the bin is decremented. The minimum value in the window lies within the range of the lowest, non-zero bin. Alternatively, the bins could point to a list of the actual values represented by that bin. In fact, the values could be stored in any standard, ordered data structure whose store time is O(log n). Alternatively, a subset of past loudness values can be used for this comparison, e.g. those that correspond with peak detection.

The Loudness-tracking Module (LTM)

The HumHorn's immediate and continuous response to the moment by moment changes of loudness in the player's voice provides a subtle, nuanced control that no keyboard instrument can match. With the HumHorn, control of volume is completely intuitive and natural; it does not first have to be translated from the mind to the fingers. It is effortless and automatic. Responsive loudness tracking is also very important for the PADM to detect rapid as well as subtle note attacks.

One way for the SAM to track the input signal's loudness is with a moving average of the sample value magnitude:

$$L(t)=(1-K)*|s(t)|+K*L(t-\epsilon), \quad (3)$$

where L(t) is the loudness at time t, s(t) is the sample value at time t, | | indicates the absolute value, and 0<K<<1. L(t) is simply a trace or low-pass filter of the sample value magnitude. This method is sufficient for tracking slow changes in loudness. It is not sufficient, however, for tracking quick changes. To detect a rapid succession of note attacks, it is necessary to track quick changes in loudness.

A straightforward way to get more responsive loudness tracking is simply to look at all the sample values in the recent past, i.e. over a window of the most recent M steps). The loudness is simply set to the absolute value of the sample in this range whose magnitude (i.e., distance from the centerline) is greatest:

$$L(t)=\max(|s(t-M)|,\ldots,|s(t)|), \quad (4)$$

where M is approximately the maximum expected wavelength for all users. Thus, as the amplitudes of the waves grow larger, the loudness increases, and as they grow smaller, the loudness decreases. When there is no input signal, the loudness is close to zero.

Equation 0 is potentially expensive to implement computationally, though some optimizations can be devised. A different method that requires very little computational overhead simply uses the actual average (not a trace) of the sample magnitudes over the past M steps:

$$L(t)=\Sigma_{j=t-k}^{1}|s(j)|/M$$
$$=L(t-\epsilon)+[|s(t)|-|s(t-M)|]/M. \quad (5)$$

This approach is computationally trivial because it requires only one addition and one subtraction at each time step. The division can be ignored because M is always the same. It also involves less program code than the other approaches, which can be an important consideration depending on hardware constraints. A similar but slightly different method measures the coastline length of the wave to estimate the amount of activity or energy it has:

$$L(t)=\Sigma_{j=t-k}^{1}|s(j)-s(j-\epsilon)|/M$$
$$=L(t-1)+[|s(t)-s(t-\epsilon)|-|s(t-M)-s(t-M-\epsilon)|]/M. \quad (6)$$

A more sophisticated method of loudness tracking accomplishes what Equation 0 describes, but it is far less computationally intensive. It too finds the maximum value in the preceding time window (of size M), but it only updates its evaluation of the loudness when a strong or weak peak arrives (instead of at every time step). As a further optimization, the only sample values used for the evaluation are those at recognized peaks. This peak-based approach fits in nicely with the peak-based FDM. The C++ code supplied in FIG. 28 implements this method.

In any of the above methods, but particularly the last, frequency information can be used to adjust M dynamically, i.e. the size of the sample window. When the fundamental frequency is high, shorter windows can be used; when, it is low, longer windows can be used. This makes the module more responsive to changes in loudness. If the correct frequency were always known, then M is optimally one time step smaller than the fundamental wavelength. This is because the full wavelength might also contain the maximum peak from the previous fundamental wave. Actually, if the loudness is only updated whenever the FDM finds a match for a peak, then M should include everything after the peak that matched, i.e. everything after the split peak of FIG. 8 for the best matching wave1 and wave2.

When no frequency information is available, the longest expected wavelength could be used for M. This avoids over-responsiveness, where rapid changes in loudness are detected that do not actually exist in the signal, which could cause too frequent note attacks by the PADM. However, more responsiveness can be obtained through a variety of heuristics that seek to estimate the wavelength from partially or completely unreliable frequency information. If no match has been found for several peaks in a row, then the proper size for M starts to become uncertain. In this case, a good heuristic is to start with M at approximately 0.9 times the most recently detected fundamental wavelength. As the frequency becomes more unreliable, M can be increased as a function, g(Δt), of the time elapsed since the last GOOD frequency reliability measurement. That is to say, $$M(t)=\min[w_{max},\ 0.9\ W(t_{im})g(t-t_{im})] \tag{7}$$

where $w_{max}$ is the longest expected wavelength, t is the current time, $t_{im}$ was the last time that the FDM detected a match, and W(x) is the wavelength at time x. This method is especially useful during the dips in loudness that accompany consonant pronunciations, when frequency detection can become unreliable.

Because attack detection is based largely on loudness tracking, the loudness-tracking module should ideally be tuned according to how sensitive the player wishes the attack detection to be. In particular, g(Δt) should depend on the vocal abilities of the individual player. There is a limit as to how fast a person can change the pitch of his voice. It is thought that most people cannot change pitch at a rate greater than about one octave in 40 milliseconds. If the goal is to minimize false attacks, then g( ) can compute the worst-case value, as though the frequency were actually to drop at this maximal rate beginning the instant of the FDM's last match; However, to increase enjoyment for a large market of users it is preferable to change M more slowly than this maximal rate. This allows for more responsive attack detection at the expense of possibly generating a few extra attacks for those users who like to change their pitch very rapidly during consonant sounds. It is convenient to use exponential functions when dealing with frequencies and wavelengths because of the human ear's logarithmic perception of pitch, and it is therefore convenient to define:

$$g(\Delta t)=2^{\Delta t/\Delta t_d}, \tag{8}$$

where $\Delta t_d$ is the time it takes for the wavelength to double, i.e. for the frequency to drop one octave. The parameter $\Delta t_d$ can be adjusted to reflect the assumed speed of the player's pitch change. In the worst-case scenario mentioned above, $\Delta t_d$ is 0.04 seconds and g(0.040)=2. Clearly, the growth rate of the sample window can be expressed in a number of ways besides Equations (7) and (8) without deviating from the essential spirit of the approach.

Figure 12:
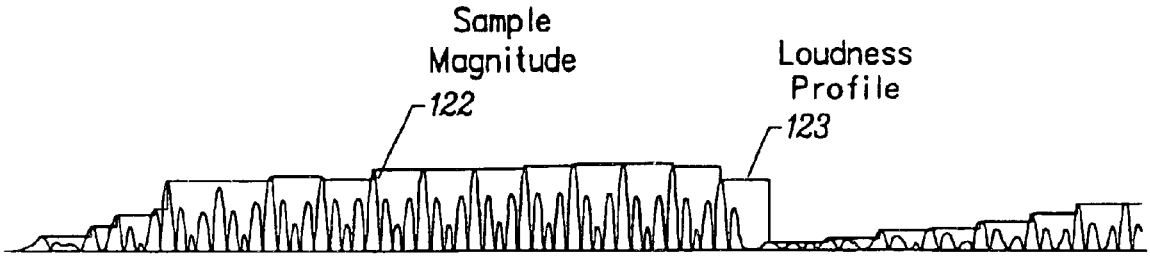
FIG. 12 is a waveform showing loudness tracking using frequency information according to the invention.

FIG. 12 shows a typical profile of loudness values obtained using Equations (7) and (8). The loudness profile 122 is overlaid on the corresponding sequence of sample-value magnitudes 123. Note that the loudness is only updated at the peaks, as described in the method above.

Additional Technical Details

Consistent with the concept of pseudo code, certain of the technical detail was left out of the code presented above. One such detail is the use of circular buffers to contain the recent data. Clearly, there is no need to keep all previously recorded data. New data is simply written over old data in a circular fashion. This technique applies to all information that is accumulated over a series of iterations. The size of the circular buffer is made large enough to hold all information necessary to process the longest possible wavelength that the human voice can produce, $w_{max}$. In general, the buffers need to hold enough data to cover a time period of just over 2 $w_{max}$.

To avoid any possible issues of ambiguity arising from the incomplete nature of pseudo code, the complete, working C++ program code is included in FIGS. 19–32.

The Sound Synthesizer Module

As was shown in FIG. 3, the sound synthesizer receives the following inputs from the SAM: note on/off, frequency, loudness, and attack. From the finger-actuated control (FAC) system, it receives parameters from the user that specify instrument, octave/offset, discrete versus continuous, and musical mode preferences, as well as perhaps other controls not mentioned here. These inputs and their relationships are now described in detail. The output of the SSM is a stream of output samples that are sent to the DAC for conversion to the output signal.

Figure 16:
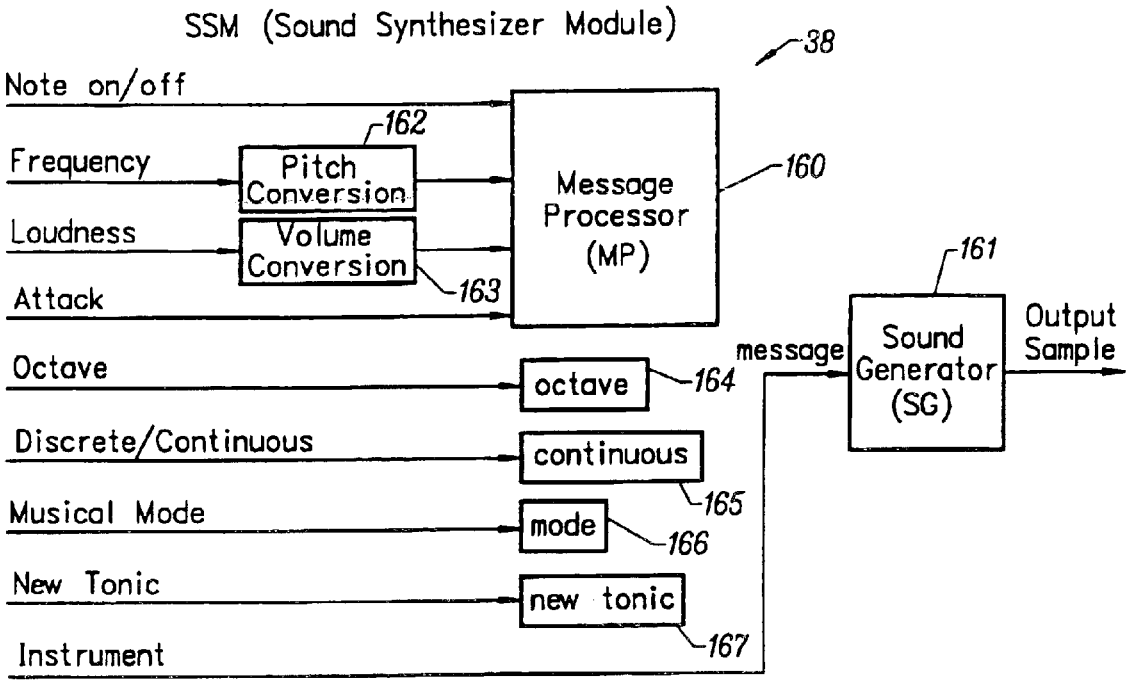
FIG. 16 is a block diagram showing the components of a sound synthesizer module according to the invention.

The internal structure of the SSM 38 is displayed in FIG. 16. The SSM consists of two primary components: the Message Processor (MP) 160, and the Sound Generator (SG) 161. The pitch-conversion and volume-conversion boxes are minor functions that are described below. The MP takes the information generated by the SAM and FAC and produces messages, which it sends to the SG. The most striking part of the SSM is the asynchronous relationship between the Message Processor and the Sound Generator. The MP receives signals from the SAM at regular intervals, preferably 8,000 Hz, 11,025 Hz, or 22,050 Hz, and the SG produces sound samples at regular intervals, preferably at the same rate. However, messages are not sent from the MP to the SG at regular intervals. Instead, messages are sent only when the output from the SG needs to be altered.

The SG generates sounds from an instrument, one note at a time. It can by itself and without further assistance produce an output signal , i.e. a series of output samples, that imitates the requested instrument playing the requested note at the requested volume. Once the note begins to play, it continues to play until it is turned off. The MP sends messages to the SG that tell it to begin or end a note. While a note is playing, the MP can send messages to alter the note in pitch and in volume. The MP can also send messages that tell the SG which instrument to imitate.

The discussion describes the pitch- and volume-conversion functions, the Message Processor, and the Sound Generator in detail.

The Pitch and Volume Conversion Functions.

The pitch-conversion function 162 takes the frequency generated by the SAM and transforms it into a pitch for the MP. Though pitch and frequency are often used to denote the same thing, there is a subtle difference. Frequency occurs naturally; pitch is man made. Frequency describes sound as a physical phenomenon (cycles per second). Pitch is psychophysical, describing sound the way we perceive it. If two frequencies are an octave apart, they have a fixed ratio, i.e. 2. In contrast, pitch is the position of an auditory frequency on a linear musical scale, such as a musical staff or a piano keyboard, where two pitches an octave apart are separated by a constant number of steps, e.g. 12. The linear scale of pitch is more natural to human understanding than the exponential scale of frequencies. In this document, pitch is understood to be a continuous value that can fall anywhere on a linear musical scale. A note also falls on a linear musical scale, but has a discrete, integer value. As stated earlier, the frequency is the inverse of the wavelength: F=1/W. Taking the base 2 logarithm of a frequency converts it to a pitch value on a linear scale, where two pitches an octave apart have a difference of one. Multiplying by 12 gives us the normal 12-tone chromatic scale. Thus, $$P=12\log_2(F), \tag{9}$$

where P is the resulting pitch, and F is the frequency as given by the FDM. Adding 12 to P increases it by an octave. Subtracting 12 decreases it by an octave.

The volume-conversion function 163 takes the loudness value from the SAM and converts it to a volume-control value for the MP. The volume can be any monotonic function of the loudness, although the preferred function is:

$$\text{volume}=A*(\text{loudness}-B) \tag{10}$$

where A is a constant scale factor and B is a constant bias. Because of the logarithmic properties of the ear, it may be desirable for the volume conversion to be an exponential function.

The Message Processor (MP)

The MP receives information from the SAM and from the FAC. From the SAM it receives four values: note on/off, attack, pitch, and volume, the latter two being converted frequency and loudness, as just described. The information from the SAM arrives synchronously: 4 values at every cycle. The FAC sends player preference values, such as instrument and octave settings. The FAC information arrives asynchronously, whenever the user wishes to change one or more parameters. For example, the player might press a button to change the instrument being imitated by the SSM, or to cause the SSM to play at an offset of one or more octaves from the pitch being sung. The MP stores the most recent settings as internal variables and applies them appropriately whenever messages are sent to the SG. In FIG. 16, four such variables are shown: octave 164, continuous 165, mode 166, and new tonic 167. Instrument-change requests from the FAC require no substantial processing by the MP and can be handled upon arrival. They are simply formed into messages and passed directly to the SG.

The variable "octave" holds a value between −3 and +3. If not zero, this variable indicates that the HumHorn should generate a pitch this many octaves below or above the hummed pitch. Only octave offsets are discussed here, but in principle, any offset from the sung pitch could be specified by the user, for example a major third (4 semitones) or a perfect fifth (7 semitones). These non-octave offsets can be used to produce pleasing and interesting parallel melodies to accompany the hummed pitches.

The variable "continuous," if TRUE, indicates that the pitch played by the HumHorn should precisely follow the pitch hummed for those with very good voice control. If the player's voice changes pitch by a tiny amount, the output pitch should change by the same amount. With continuous pitch tracking, the instrument can follow all the subtle pitch variations used by the player, including vibrato. As a result, the instrument can sometimes have an unpleasant, whiny quality, which is more pronounced for some instrument sounds than for others. For example, it is almost impossible to make a piano sound like a piano when doing continuous pitch tracking. It ends up sounding more like a honky-tonk piano. Additionally, few people have particularly good pitch-control of their voice. For these reasons, the HumHorn provides the option of having the instrument play the note nearest to the user's pitch. Then, even if the player's voice wavers a bit, the pitch of the instrument remains steady. Thus, if continuous is FALSE, then the pitch played should be rounded up or down to the nearest note in the musical scale or mode selected by the player, as is described below. The variables "mode" and "new_tonic" are also described below.

Pseudo code for the Message Processor is shown in FIG. 17. In line 2, the pitch is modified to reflect the pitch scale of the SG as well as the current octave variable. The SG is assumed to have a linear pitch scale discretized into half-step intervals, which correspond to the traditional notes on a keyboard. This is the system used by the MIDI protocol. The starting note in the scale is arbitrary and depends on the SG. The value synthesizer_offset is the difference between a pitch on the mathematically derived pitch scale, as described in Equation 0, and the corresponding pitch for the SG. This is a constant offset for all pitches. For the MIDI protocol, the frequency 440 Hz corresponds to the $69^{th}$ note on the keyboard. In this case, the synthesizer offset is 12 $\log_2(440)-69$, or about 36.38 (just over three octaves).

At line 5, the note closest to pitch is calculated for the musical mode chosen by the player. A musical mode is a subset of the eleven semitones in an octave. Examples are: major, minor, blues, chromatic, and many more esoteric modes, such as dorian, phrygian, whole-tone, and pentatonic. The chromatic mode consists of every semitone in the octave, numbered 0–11. The major mode consists of the following semitones: {0, 2, 4, 5, 7, 9, 11}. The first note in the mode (note zero) is called the tonic, and all semitones in the mode are an offset from the tonic. The mode variable allows the user to select which mode to use. By pressing the finger-actuated control assigned to the variable "new_tonic," the player can dynamically assign the tonic to whatever pitch he/she is currently singing. If pitch following is continuous, then the chromatic mode is used (lines 3 and 4), so the nearest semitone is looked up. The nearest_mode_note routine is described below.

Lines 6–13 decide whether there are reasons to issue an attack despite the fact that there is no attack signal from the SAM. The two cases at lines 8–9 and lines 11–12 correspond to cases 3 and 4, respectively, discussed above. In the first of these, pitch tracking is continuous (line 8) and the pitch has moved beyond the range where the synthesizer can produce smooth pitch changes based on the attack pitch (line 9). The attack pitch is current_note at line 7, which was set on a previous attack (line 16). The range that the pitch has exceeded is MAX_BEND_RANGE in line 9. In the second case (lines 11–12), pitch tracking is discrete, and the pitch is much closer to another note in the mode then to the attack note (line 12). The attack note for this case is again current_note. MAX_PITCH_ERROR, a value between 0.5 and 1.0, determines how much closer the pitch has to be to the other note. A value of 0.5 indicates that the pitch should be rounded to the nearest note. A value greater than 0.5 acts as a kind of hysteresis, keeping the note from changing when the player's voice is a bit unsteady.

Lines 14–33 send the SG the appropriate message for the current situation, if any. If an attack has been issued for any of the reasons given above, and therefore for any of the four cases described above, then a message is sent to play the new note at the new volume (lines 14–22). Whether pitch following is discrete or continuous, the SG receives a message to play nearest_note, an integer note value. If pitch following is continuous, then the SG also receives a message to bend the pitch up or down by a certain amount so as to match the input frequency. Lines 15 and 16 store the note and volume for future reference. If the SG is currently playing a note, then line 18 sends a message to the SG to stop. Line 19 issues the message to play the new note at the new volume. If pitch following is continuous (line 20), the new note is adjusted to match the pitch of the player's voice (line 21). The time of the attack is recorded (line 22).

Starting at line 24, there is no attack but the synthesizer is still playing a previously attacked note. If the SAM has sent a Note Off command (line 24), then a message is sent to the SG to stop playing (line 25). Otherwise, a note is currently playing and should continue to play, but perhaps its pitch or volume should be adjusted (lines 26–33). Because it may take a while for the SG to process its commands, changes to pitch and volume are only sent out every so often. The value SG_REFRACTORY_PERIOD depends on the SG, and specifies how much time needs to elapse before a new pitch or volume message can be sent. If the new volume is significantly different from the volume already playing (line 27), then a message is sent to the SG to adjust the volume to the new value (line 29) and the new volume is stored (line 28). If pitch following is continuous and the pitch has changed (line 31), then the pitch is adjusted (line 32). In both cases, the time is recorded (lines 30 and 33) for use again at line 26.

The adjust_pitch routine depends again on the SG. For the MIDI protocol, it is possible to adjust the pitch via pitch bend, as well as to adjust the maximum allowable pitch bend range (MAX_BEND_RANGE). The adjust_pitch routine does both, if required.

The function that returns the nearest mode note is shown as pseudo code in FIG. 18. Four modes are defined at the beginning, though there could be many others. Each mode is defined in terms of the semitones that make it up, starting from the tonic, at position zero, and ending one octave above the tonic, at position 12. In the major mode, the second note is two semitones above the tonic. The next is two more semitones above that, i.e. four above the tonic. The next is one more semitone up. The tonic is itself is an integer between 0 and 11 and is a note in the lowest octave of the linear pitch scale. The twelfth semitone above the tonic is one octave above the tonic, but it has the same place in the mode as the tonic and is also considered to be the tonic. In fact, all modes are octave blind, i.e. they are offsets from the nearest tonic below. Thus, if the pitch is 38.3 and the tonic is 2, then the nearest tonic below 38.3 is 36 (2+12+12+12). When the new_tonic variable is set, the integer, i.e. semitone, closest to the given pitch is stored as the tonic, but reduced to the first octave in the scale, so that it has a value between 0 and 11 (line 7). The variable "offset" is the difference between pitch and the nearest tonic below it (line 8). At line 9, mode_note (an integer) is the number in the specified mode that is closest to offset (a real). The difference between them (line 10), when added to the original pitch, gives the closest mode note (line 11).

The Sound Generator

There are two principle ways that the Sound Generator can be implemented: with a standard MIDI (Musical Instrument Digital Interface) module, or with a self-designed synthesizer. Because the demands on this module are far less than the capabilities of most MIDI systems, it may be preferable to build and design a custom synthesizer module so as to save chip space. On the other hand, the capabilities of off-the-shelf MIDI chips are generally sufficient for our purposes, and in fact the messaging methodology of the Message Processor was designed to conform to MIDI standards. A MIDI processing unit could therefore meet our specifications with little or no modifications.

Hardware Components

The Humhorn consists of the following hardware components, each either custom built or off the shelf:

1) A housing for containing all of the following components as well as batteries;
2) A microphone;
3) One or more speakers;
4) Electronics, including:
   a) An ADC,
   b) One or more chips for executing the:
      i) SAM,
      ii) MP, and
      iii) SG;
   c) A DAC,
   d) An amplifier, and
   e) a volume control,
5) Finger-actuated control switches, buttons, and dials; and
6) Optionally a small display for helping the player to choose parameters and/or to indicate which parameters are set.

All of these components are straightforward. Only 4)b) requires significant thought as to how best to implement it. Three possible implementations are:

A monolithic solution, whereby all three processing elements are combined on a single chip—whether custom-designed or off the shelf—programmed to the specifications described above;

Two separate chips: one for the SAM and MP, programmed to the specifications described above; the other for the SG, probably an off-the-shelf MIDI chip, but possibly another general-purpose chip programmed for sound synthesis; or An off-the-shelf MIDI chip or other sound synthesizer that allows some on-board custom programming, into which the code for the SAM and MP are placed.

In each of these cases, the ADC, DAC, or both might already be resident on the chip. The filtering mechanism of the SAM could be replaced by a filtering microphone or other mechanism that performs the necessary band-pass filtering mechanically or with analog circuitry.

As for the finger-actuated controls, it is desirable to have at least two different kinds: those that switch and stay in position, and those that return upon release. As an example, consider the FACs used for pitch tracking. It is best to have a switch that can be set in continuous or discrete pitch-tracking mode and that stays there once set. It is also desirable to have a button that temporarily changes to the opposite mode. Thus, when the player is in continuous mode and wants to quickly nail down a pitch, or to sing a quick scale in a musical mode, he can press the button and then immediately release it when done. Similarly, while in discrete mode, the player can quickly slide to another pitch—including one outside the current musical mode—by temporarily pressing the button, then immediately pop back into key by releasing the button. Buttons are also desirable for quickly changing between instruments and octaves, allowing the player to be a one man band.

The housing of the instrument may itself have a variety of purposes and functions. In particular, the housing may come in two sections: An inner container and an outer shell. The inner container holds the electronics and batteries in a simple, convenient, easy-to-handle, self-contained unit. Its purpose is to hold the heavy and high-priced items in a compact and modular form. The contribution of the outer shell is its styling. The outer shell can be manufactured to resemble any traditional or novel instrument form, for both its visual and/or its acoustic properties. The shell may contain the microphone and/or speaker(s) as well. The inner and outer housings can be manufactured such that they are easily separated. When they are properly fit together, the shell provides information to the inner container by way of a physical key on the inner surface of the outer shell that fits into a corresponding slot on the outside of the inner container. Together with other possible information, the key would provide a description of the expected instrument sound that the SG should produce. Thus, by pulling the inner, container from a shell in the form of one instrument and inserting it into another shell in the form of a different instrument, the sound produced by the SG would change from that of the former instrument to that of the latter. A multitude of different shells could be manufactured so that the player can get not just the auditory impression, but also the tactile and visual impression of playing a specific musical instrument.

Neck Microphone

Instead of having the user hum into a mouthpiece, which would contain a microphone, as discussed above, it is also possible to place a microphone on a cloth collar. This collar wraps around the neck such that the microphone is pressed slightly against the throat. Because only the pitch is being detected, the audio quality is otherwise not important—this is why this procedure works. It may be convenient not to have to worry about holding a microphone or having the mouth near a microphone.

Funnel Microphone

Instrument mouthpieces are unsanitary and make one reluctant to share one's instrument. A funnel-shaped receptacle on the microphone end of the instrument psychologically and mechanically discourages holding one's lips against it. Furthermore:

- It allows greater freedom of lip motion, which is important for forming consonant sounds, important for producing a fast sequence of attacks;
- It forms a better entrance for the sound of the user's singing/humming; and
- It helps to hide the sound of the player's voice, so that listeners instead can concentrate on the sound of the instrument.

Parameter Values

The parameter values set forth in Table B below work well in tests performed.

TABLE B

Parameter Values

| Parameter | Reference Location | Preferred Value |
|---|---|---|
| MAX_LENGTH_RATIO | FIG. 8 | 0.12 |
| $w_{max}$ | Eq. 4 | 0.02 seconds |
| $\Delta t_d$ | Eq. 8 | 0.10 seconds |
| Low cutoff frequency | | 100 hz |
| High cutoff frequency | | 300 hz |

TABLE B-continued

Parameter Values

| Parameter | Reference Location | Preferred Value |
|---|---|---|
| MAX_AMPLITUDE_DIFFERENCE | FIG. 8 | 40 (based on 8 bit sample values) |
| MAX_DIFFERENCE_WHEN_NOTE_ON | FIG. 8 | .2 |
| MAX_DIFFERENCE_WHEN_NOTE_OFF | FIG. 8 | .1 |
| MIN_WAVELENGTH | FIG. 8 | 53 samples (at 22,050 sample rate) |
| MAX_WAVELENGTH (this corresponds to $w_{max}$) | FIG. 8 | 463 samples (at 22,050 sample rate) |
| N_SAMPLES_PER_CHECKPOINT | FIG. 9 | 11 |
| MAX_VOICE_SPEED | FIG. 10 | .2 |
| MIN_ATTACK_GAP | FIG. 14 | .1 seconds |
| MIN_ATTACK_LOUDNESS | FIG. 14 | 10 (based on 8 bit sample values) |
| MIN_LOUDNESS | FIG. 14 | 8 (based on 8 bit sample values) |
| MIN_TIME_OFF | FIG. 14 | .05 seconds |
| MAX_CONSECUTIVE_WEAK | FIG. 15 | 5 |
| MAX_PITCH_ERROR | FIG. 17 | 0.75 semitones |
| MAX_BEND_RANGE | FIG. 17 | 2 semitones |
| SG_REFRACTORY_PERIOD | FIG. 17 | .02 seconds |

The above parameter values are exemplary only and not intended to be limiting. In actual practice, other parameter values would be equally suitable.

Additional Issues

Latency Issues and the "Pre-attack"

For a note attack with a previously undefined frequency, the FDM described above has a delay of less than 30 milliseconds (about 1/30th of a second) from the time the new pitch is begun by the singer until it is finally detected by the FDM. This assumes that the lowest note sung is C two octaves below middle C, having a frequency of 65 Hz (an exceptionally low note), in which case one cycle takes 15 milliseconds and two cycles take 30 milliseconds. If the SSM generates a new instrument attack only after the FDM detects the pitch, this attack may be slightly noticeable and possibly jarring, emphasizing this delay. It is possible to reduce the impression of delay in the following way. For each instrument there is a non-voiced attack sound. When the singer's voice reaches a threshold, the SSM begins playing the unvoiced attack sound. Then, starting when the FDM detects the pitch, this unvoiced sound is gradually blended into the sound of the instrument attack at the detected pitch. This would require specialized MIDI programming if standard MIDI were to be used.

Pitch Smoothing

It was mentioned above that the instrument can sometimes sound whiny during continuous pitch tracking due to the minor pitch variations of the singer's voice, which the sound of the HumHorn may actually accentuate. It is possible to mitigate this whininess significantly by smoothing the resulting pitch profile played by the instrument. That is, the intent of the pitch-smoothing function is to allow the flexibility of continuous pitch tracking, while mitigating the whininess exhibited by some instruments with some people's voices.

One way of smoothing pitch is to pass the pitch profile generated by the FDM through a low-pass filter. A better method is obtained by using principles from control systems theory. Think of the pitch played by the instrument as tracking the pitch profile generated by the FDM. We can add mass to the pitch of the instrument in the way that this tracking occurs. In particular, $$E=P_{FDM}-P_{inst}$$

$$d^2P_{inst}/dt^2=k1*E+k2*\text{int_time}(E)-k3*dP_{in}/dt, \quad (11)$$

where $P_{FDM}$ is the pitch indicated by the FDM, $P_{inst}$ is the pitch to be played by the instrument, E is the pitch-tracking error between the instrument and the output of the FDM, int_time( ) stands for integration over time, and k1, k2, and k3 are constants. The above is known in control systems as a proportional-integral-derivative (PID) control law, and it is a reasonably effective way of having the $P_{inst}$ smoothly track the $P_{FDM}$. A The derivative term (the third term) stabilizes $P_{inst}$, because it has a dampening effect. It is used to dampen out oscillations in the control. The integral term improves the accuracy of the tracking. By changing the values of the constants, we can obtain various levels of smoothing, tracking accuracy, and response times. In fact, there are probably better control laws than this for this purpose, such as lead-lag control, but the main idea is presented by the PID control law.

If a pitch-smoothing method is used, there should be a means for automatically disabling it whenever there is an intentional note change, or any kind of relatively large change in frequency. Recall that the smoothing is intended only to remove the whininess, which involves only small frequency variations (generally less than a semitone). This strategy can be implemented simply by setting $P_{inst}=P_{FDM}$ whenever the change in $P_{FDM}$ exceeds a certain threshold.

Network Extensions

The following ideas are related to HumBand™ technology, in particular, the use of the HumBand™ in relation to the Internet, for example, as an Internet appliance. The HumBand™ voice-analysis process extracts a small amount of important information from the voice stream and uses it to play the desired instruments. It is estimated that an uncompressed bandwidth of no more than 300 bytes/second is necessary to capture all nuances, but this can be greatly compressed to an estimated 500 bits/second on average with no loss, perhaps less. A three-minute song would therefore consume approximately 11 Kbytes for one voice. Multiple voices require proportionately more. This is quite a low number and suggests that HumBand™ email, downloads, and other forms of HumBand™ communication can be performed with minor overhead.

Group Interactive Musical Performance Via Web/chat-like Service

To use this service, one becomes a member of an online group after one logs in with name and password to the HumJam.com web site. Each person in the group is at any particular time either an audience member or a performer.

Audience Member: As a member of the audience, one may comment and discuss upon a performance in real time, during the performance. There may be special symbols or auditory icons that have particular meanings and that can be sent to the performer. For example, applause, bravo's, catcalls, laughter, cheers, and whistling, that the performer hears. In addition, each audience member may participate in a round of voting to express his subjective opinion as to the quality of the performance.

Performer: The performer is attracted to the session because of his innate hidden desire to perform live in front of an audience. This is exciting and fun, and due to the anonymity of the Internet as well as the vocal disguise provided by the HumBand™, it is also less intimidating than an on-stage performance. Imagine performing for a crowd of tens or hundreds (or even thousands!) in the secluded comfort of your home. During the performance, the HumBand™ instrument is connected via an interface directly to the Internet so that the performance can be transmitted live via the HumJam.com web site. The performer receives live feedback from the audience members, and at the end of the performance may receive a rating by said members.

Voting is performed for three purposes:

To increase/decrease level of performance group. When someone's rank (through voting) has increased to a great enough level, one may then participate in a performance group at a higher-ranked level. At that level, one performs for an audience of equally ranked performers. For example, say that entry level is rank 1. At rank 1, everyone may play and everyone may vote. Those with sufficiently high votes can move up to rank 2. At rank 2, one is only judged by others who have reached rank 2 or higher.

To increase/decrease rank and weight in voting. When a person of a rank higher than the rank of the performer votes on the performance, his vote counts more than the votes of those whose rank is lower.

To increase/decrease chances of receiving a prize. Prizes can be given on a regular basis, e.g. daily/weekly/monthly, to the performer who has the highest rank for that time period or, possibly for the performer whose rank has increased the most for a given period. A rank then is similar to one's handicap in golf, in that one's chance of winning a prize depends on how well one does with respect to one's previous or average ability.

The method above is a suggestion of a single kind of interactive scenario that could appeal to the competitive and performance-interested nature of many people. Further, one kind of prize would be the opportunity to perform for a very large audience, such as the combined audiences of all groups, or specially advertised events which feature the winning performers (of any ranking).

An international endeavor. Such interactive performances would be one of the only online examples of true, unhindered, international communications because music breaks cultural/linguistic barriers. The Internet and HumBand™ could usher in a kind of immediate international communication never seen before.

Technical Issues

Each performer and audience member is able to participate via his Internet-capable HumBand™. All performers send information via their HumBand™. All audience members listen to these performances via their HumBands™/PCs/PC headphones/HumBand™ headphones/or other HumBand-codec enabled appliance.

The performer plays along with an accompaniment provided by the HumJam.com HumServer™. The server sends the accompaniment information via the HumBand codec to the performer. The accompaniment is played on any enabled appliance The HumBand codec is very similar to MIDI, but perhaps optimized for voice-control.

The performer plays in synch with this accompaniment and his signal is sent via this same codec back to the server. The server only then broadcasts the performance to the audience. For the audience, the performer and accompaniment are in perfect synchrony. There is no latency issue. This is because the server receives the performer's signal and is able to combine it with the accompaniment, properly timed such that the resulting signal reproduces the performance as heard by the performer. Thus, though there is a slight delay, the performance is nonetheless broadcast live and is full fidelity.

Audience members send their comments and votes to the server, which tallies, organizes, and distributes them.

Multi-performer Jam Sessions

This scenario is hindered mostly by the latency issue. In particular, there is a noticeable time delay between when a performer sends a signal via the Internet and when it arrives. For most forms of communication, this limited latency is not deleterious because synchrony is never required. A delay of 200 ms between the transmission of a communication and its receipt is hardly noticeable. However, if multiple parties are attempting to synchronize a sound, such a delay makes this impossible. Each performer waits to hear the other's signal to synchronize. This delay additionally increases the delay at the other end. The effect snowballs and no form of synchrony can be maintained.

To eliminate this cascade (snowball) effect, and to mitigate the general latency problem, but not eliminate it entirely, a central server—a conductor—can send a steady pulse, e.g. a metronome tick, to all parties, timed such that each party receives the signal simultaneously. Each performer can then time his performance to match this pulse and expect a slight delay from the other performers, gradually (or perhaps quickly) learning to ignore and adapt to this slight delay. The pulse is effectively the accompaniment. Software at the performer's site can account for this delay upon the conclusion of the piece, and can replay for each performer, the sound of the whole performance without the delays.

Group Compositions

The concepts above can be combined to allow voting on individual musical parts that are subsequently joined together to produce a group-effort HumBand™ composition.

Song Email, "HumMail™"

One can record and send single- or multi-part songs that one has recorded on one's HumBand™ through email to friends, who can play the songs on their own HumBands™.

Song Downloads

Performances can be downloaded from the site, different pieces played by various interesting and/or famous performers. Because the information downloaded is much more precise, containing far greater subtlety and nuance, than typical MIDI performances, one can expect greater realism and appeal.

Accompaniment Downloads

The accompaniment sections of many, many different pieces could be made available such that one could download them (low bandwidth) into one's HumBand™ and then play along with them.

Composition Chain Letters

Just as one can download an accompaniment, one can receive an accompaniment by email, add a track to it, and send it on, a sort of "serial jamming." Alternatively, incomplete pieces could be uploaded to the site to allow others to jam with and possibly contribute to as well.

Auto-accompaniment

There is a software product on the market that provides automatic accompaniment for instruments and voice. The performer chooses a song and the software plays the background while simultaneously following the performer's voice/instrument. The speed of the accompaniment is continuously modified to match the speed of the performer. A similar system could be built for the HumBand™, perhaps in alliance with this company, that follows the performer and supplies an intelligent accompaniment. These accompaniments could be downloaded from the web site.

Context-sensitive Pitch Correction

Song scores could be downloaded into the HumBand™ and played back following the performer's voice, matching the actual voice with the intended music. Even players with very poor pitch control could play in perfect tune. Instrument and octave changes could be included to occur automatically at specific places in the song.

Instrument Wave-table Downloads

As new instrument sounds (both natural and synthetic) become available, their wave tables can be posted to the web site. Thus, HumBand™ owners can at any time access an enormous library of interesting instrument sounds from the Internet, and their selection of possible sounds is greatly expanded over the few that are installed on the HumBand™ at the time of purchase. The data required for a wave-table download is not as negligible as for a song download.

Control-software Downloads

Software, "Humlets™", could be downloadable from the site into the HumBand™ and could modify control in a variety of useful ways, such as:

- Add/improve effects, such as echoplex, chorus, and other distortions.
- Add capability, such as additional ornaments/riffs that can be invoked by the player at will. These riffs/ornaments can be context sensitive such that they are played differently depending on the scale degree, rhythm, and style of the piece at the moment of invocation. The style of the piece could be chosen together with the download. Examples are: baroque, classical, jazz, Dixieland, and hard rock. This context-sensitivity could be applied according to a particular formula set up in advance (in hardware), or could be embodied in down loaded software.
- Add new functionality, that could, for example, modify/improve the way in which context-sensitive effects and accompaniments are played.
- Modify core functionality. As our pitch-recognition and attack detection algorithms improve, these improvements could be downloadable as updates.
- New core functionality. The very basics of the HumBand™ could be modifiable. For example, new functionality could be added such as timbre-control through the recognition of certain vocal nuances, e.g. changes in vocal harmonics.

Instruction

Also available from HumJam.com web site: music instruction. Instruction could be human (paid), or software (free). Software could be used on or offline and would, for example, help the learner improve pitch control. This could be done by playing a selection for the learner or alternatively, allowing the learner to read a score, and waiting for the learner to play what he has heard or read. The software could show both the correct pitch and the learner's pitch as two simultaneous real-time graphs. The learner could then see visually when his pitch is too high or low.

Extra-high Fidelity

If the performance capabilities of the player's HumBand™ are inadequate (depending on the model), he can send HumMail™ to the web site and receive in return a compressed version of the recording, e.g. in MP3 format, performed on the best-available HumBand™ equipment.

Because this would be a somewhat cumbersome process, no player would do it as a matter of course, but it would be a useful service in those cases when the performer wants to polish and keep a particularly good recording. Most importantly, it would provide good exposure for the top-of-the-line equipment, thereby increasing sales.

Instructional Games

The HumJam.com site could sponsor HumBand™ games for online use or to download. One example is a "Simon"-like game, where the player must mimic a sequence of notes. When the player repeats the notes correctly, the sequence is extended by another note. Besides simply singing the notes in order, the player might also have to play them with different instrument sounds which change between notes, or in changing octaves.

Infrared Networking

The HumBand™ could be built with an I/R port to allow wireless networking between instruments present in the same room. Possible uses are:

Shared speakers. Each player's HumBand™ could play the output from all participating players, allowing each person to hear the entire group through his own HumBand™.

Silent jam sessions. Each player connects headphones to his/her own HumBand™ and can hear all the instruments play. Observers would only hear a bunch of humming. Good for late nights and sensitive neighbors.

Synchronization. The HumBand™ could automatically adjust to a beat given by a central source, or averaged over the various players, to help recognize and produce attacks and releases. This would encourage a more organized sound among beginners, such as school children in HumBand™ choir bands.

Group pitch correction. The same concept as above can be applied to pitch regularization. The pitch-correction algorithms can be adapted to best accommodate the average player, automatically adjusting the pitch of outliers to conform to the rest of the band.

Stand-alone play. Multi-part pieces that have been pre-recorded can be played back on a group of instruments, each taking a single voice and playing it in time with the other instruments. Standing unattended, a group of instruments could give an eerie impression of an invisible band. Or, properly performed, an impressive recording can be brought to life before the eyes of the audience. This is not an interactive application of the HumBand™, but friends and neighbors might not realize this.

HumJam.com local jam performances. Local jam sessions among groups of friends sitting together in the same room could be broadcast through the HumJam.com web site. I/R networking, negligible latency, and low bandwidth allow the LAN band to broadcast the entire performance live on the Internet.

Auto parts. Because there are multiple notes being played at once, the harmony can be deduced and new musical parts can be invented automatically and played together with the rest of the band: the AI jammer.

Sophisticated interactions. There is the potential for a new paradigm of musical cooperation that can emerge when all the instruments in the band become both interconnected in real time, and operated at a very high level of control. This is a fundamentally different kind of interplay than exists in bands today. The possibilities for interaction seem endless, for example:

Conductor-controlled performances. Imagine a band where the conductor controls the performance not just indirectly, through hand gestures, but directly, by dynamically choosing the instrument sounds of each section! Other parameters, such as pitch, octave, and volume, could also be controlled.

The avant-garde. Modem composers often like to add randomness and complexity to performances through the use of interactive dynamics. Each HumBand could be programmed to cooperate with the others such that playing certain notes or choosing certain parameters on one instrument automatically changes the parameters on another instrument. An organic synergism could unfold where the players themselves are as surprised as the audience by the continually changing nature of the performance.

Use of an Adaptive Module with the FDM

Figure 33:
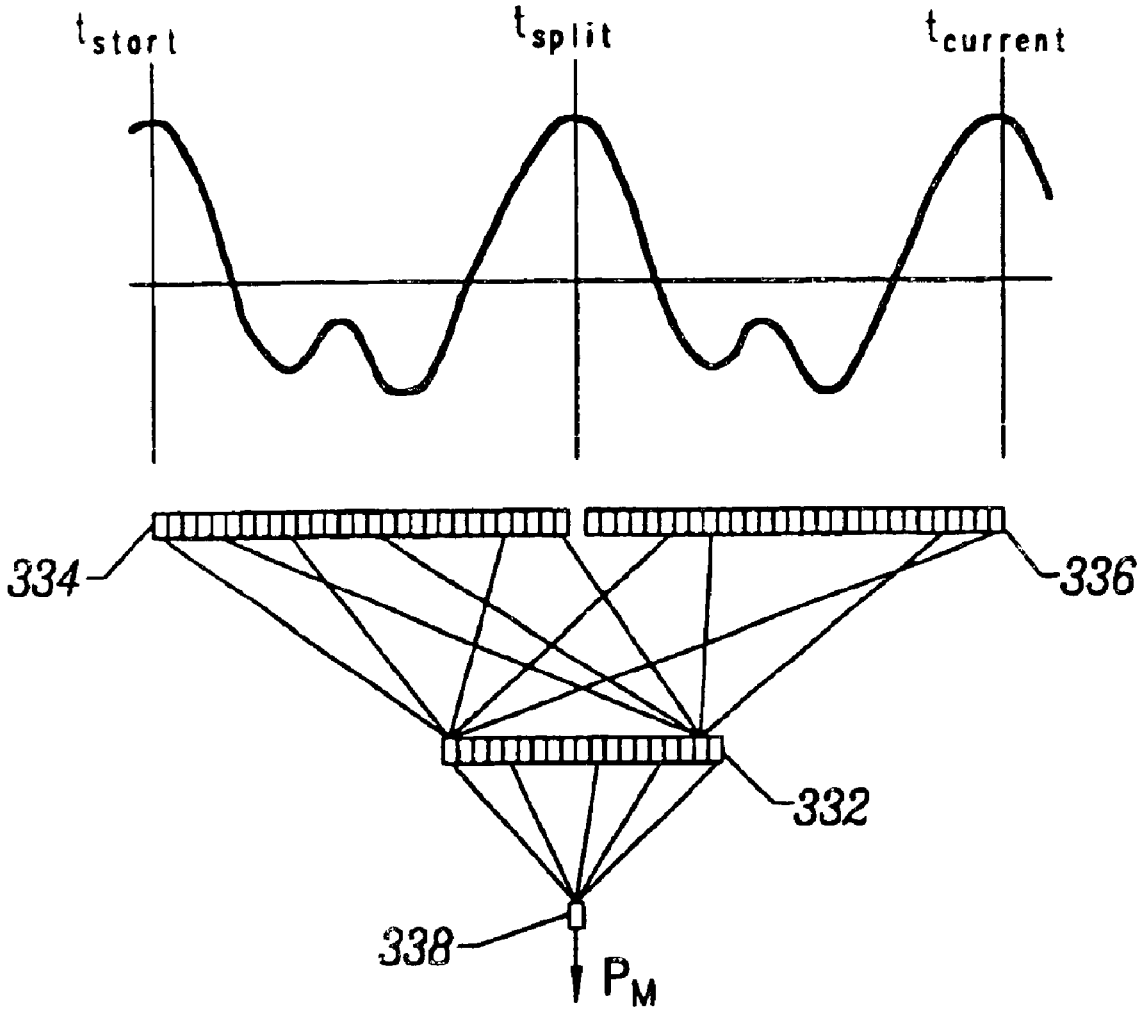
FIG. 33 is a schematic diagram that shows a neural network architecture for determining the probability of a wave shape match.

The reliability of the FDM can be enhanced significantly by the addition of an adaptive module, such as a neural network. In fact, the architecture for the FDM is very amenable to this enhancement. The present approach is to incorporate the adaptive module into the wave shape comparison routine to essentially replace the code in Box 63. FIG. 33 shows a feed-forward multi-layer perceptron (FFMLP) neural network whose inputs are the sample values at equally spaced intervals along the waves. The first wave shape (between $t_{start}$ and $t_{split}$) is input to input layer 334, and samples from the wave between $t_{split}$ and $t_{current}$) are inputs to input layer 336. Connections from the said input layers are then fed forward to the hidden layer 332, and connections form this layer are fed forward to the single output node 338. The desired output of the latter, i.e. of the network is the probability that the shape of the first wave matches the shape of the second wave. The variable "difference" (see FIG. 9) is defined to be inversely related to this probability in some manner.

There are many ways to preprocess the input to the network, and there are many types of adaptive modules that could serve the same purpose. Furthermore, a network or other adaptive algorithm can be built to replace both box 62 and box 63. This algorithm takes as its input a specific number of the most recent samples, and the algorithm is trained to produce at its output an estimate for the split point within those values. However, the advantage of the FDM is that a much smaller set of waves are tested for matching compared to standard auto-correlation approaches. The FDM is therefore still efficient even when a more complex and adaptive shape-comparison module replaces box 63.

One very popular way to train a FFMLP is with a back propagation algorithm. As with any supervised learning method, the network requires examples of desired outputs for given inputs. A large collection of sound files (SF's) must be obtained from a representative subset of the expected population of users, and these files are then labeled where appropriate to designate what the desired inputs and outputs should be. For example, each sound file could have an accompanying label file containing triplets of the form $t_{start}$, $t_{split}$, and $t_{current}$ which denote offsets in the wave file, together with target values for box 108. The target value is equal to one when the segments match and zero when they do not match. This type of supervised training for FFMLP's is quite well known and understood. Alternatively, the user could provide feedback directly to the network when the pitch produced by the HumHorn is incorrect. In either case, the network adapts to reduce the probability of error in similar situations in the future.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

What is claimed is:

1. A hand-held, voice-controlled electronic musical instrument, comprising:

a mouthpiece where a user's voice enters;

a voice-to-pitch conversion module, wherein said voice-to-pitch conversion module comprises a pitch-detection technique for a voice controlled musical instrument;

one or more user controls;

one or more sound-reproduction devices coupled to the voice-to-pitch conversion module;

a power source; and an enclosure, said enclosure formed in a shape that most nearly represents an actual musical instrument that said electronic instrument is to represent;

wherein said mouthpiece, voice-to-pitch conversion module, one or more user controls, power source, and one or more sound-reproduction devices are entirely contained within the confines of said enclosure;

wherein said instrument is self contained;

wherein said instrument produces a sound that is representative of the sound produced by the actual musical instrument represented by said enclosure; and wherein pitch and volume of said instrument substantially follow the pitch and volume of said user's voice.

2. The instrument of claim 1, wherein said pitch-detection technique comprises:

determining recent time steps;

summing differences over a small subset of recent time steps to find a correct fundamental frequency;

determining wave segments; and comparing only wave segments bounded by wave-shape features such as peaks or zero crossings;

wherein said pitch-detection technique comprises fewer wave-shape comparisons before a fundamental wavelength is detected.

3. The instrument of claim 1, wherein said voice-to-pitch conversion module comprises:

a frequency-detection module for receiving an input signal, for a calculating frequency of said input signal, and for providing an output signal indicative thereof to a sound synthesizer;

a loudness-tracking module for receiving said input signal, for determining loudness of said input signal, and for providing an output signal indicative thereof to a sound synthesizer; and a note-attack module for receiving said note signal, for determining a note on/off value and an attack value, and for providing an output indicative thereof to a sound synthesizer.

4. The instrument of claim 1, wherein said one or more user controls comprises either of controls that switch and stay in position upon user actuation, and controls that return upon user release.

5. The instrument of claim 4, said one or more user controls further comprising:

a switch that can be set in continuous or discrete pitch-tracking mode and that stays there once set.

6. The instrument of claim 4, said one or more user controls further comprising:

a button that temporarily changes said instrument to an opposite mode wherein, when said user is operating said instrument in a continuous mode and wants to select a pitch, or to sing a quick scale in a musical mode, said user can press said button and then immediately release it when done.

7. The instrument of claim 4, said one or more user controls further comprising:

a button by which a user, while said instrument is in a discrete mode, can quickly slide to another pitch, including a pitch outside a current musical mode, by temporarily pressing said button; wherein said instrument then immediately returns to key when said user releases said button.

8. The instrument of claim 4, said one or more user controls further comprising:

a button for quickly changing between octaves.

9. The instrument of claim 1, wherein said enclosure comprises:

an inner container and an outer shell;

wherein said inner container holds said voice-to-pitch module and said power source in a self-contained unit; and wherein said outer shell is manufactured to resemble a traditional musical instrument, for any of its visual and its acoustic properties.

10. The instrument of claim 9, wherein said shell contains any of said mouthpiece and said one or more sound reproduction devices.

11. The instrument of claim 9, wherein said inner container and said outer housing are formed to fit together, wherein said shell comprises an instrument description and a communication path that provides information to said inner container comprising a description of an actual instrument sound that an instrument which shell resembles, reproduces;

wherein pulling said inner container from said shell which shell is produced in the form of one instrument and inserting it into another shell that is provided in the form of a different instrument, configures said inner container to provide a sound produced by an instrument that the shell to which said inner container is currently noted resembles.

12. The instrument of claim 11, wherein a physical key on an inner surface of said outer shell fits into a corresponding slot on an outside of said inner container to configure said instrument to reproduce a sound associated with an actual instrument having the shape represented by said outer shell.

13. The instrument of claim 11, further comprising:

a plurality of different outer shells having a shape that comprises a tactile and visual appearance of a specific musical instrument.

14. The instrument of claim 1, wherein said enclosure is provided in the form of any of a trumpet, trombone, saxophone, oboe, bassoon, clarinet, flute, piano, electric guitar, voice, or whistle.

15. The instrument of claim 1, wherein said voice-to-pitch module implements a combination of auto-correlation and zero-crossing or peak-based pitch detection.

16. The instrument of claim 4, said one or more user controls further comprising any of:

a tonic setting button for a musical mode and a musical mode selection button.

17. The instrument of claim 4, said one or more user controls further comprising:

at least one instrument selection button for effecting permanent or temporary change of said instrument, optionally by permanently or temporarily assigning an instrument to a button wherein pressing said button changes a sound produced by said instrument to a sound of another instrument that is assigned to said button until said button is released or changed.

18. The instrument of claim 1, wherein said enclosure comprises:

an inner container and an outer shell, said power source contained in one of said inner container and said outer shell;

wherein said inner container holds said voice-to-pitch module, so that said power source and said voice-to-pitch module constitute a self-contained unit; and wherein said outer shell is manufactured to resemble a traditional musical instrument for any of its visual and its acoustic properties.

19. A voice-controlled electronic musical instrument, comprising:

a cup or funnel-shaped receptacle where a user's voice enters;

a signal analysis module for analyzing the user's voice;

a sound synthesis module coupled to said signal analysis module;

at least one sound-reproduction device coupled to said sound synthesis module; and an enclosure having a hand-held form factor;

wherein said instrument is self contained; and wherein pitch and volume of said instrument substantially follow the pitch and volume of said user's voice.

20. The instrument of claim 19, further comprising:

means for producing an automatic accompaniment;

wherein one instrument sound is controlled by the user's voice and at least one additional instrument sound is controlled by said accompaniment means;

wherein the user can play a solo along with said accompaniment.

21. The instrument of claim 19, said signal analysis module further comprising:

means for determining recent time steps;

means for applying either of a sum of differences and a sum of products over a small subset of recent time steps to find a correct fundamental frequency;

means for determining wave segments; and means for comparing only wave segments bounded by wave-shape features;

wherein fewer wave-shape comparisons are required before a fundamental wavelength is detected.

22. The instrument of claim 19, wherein said enclosure resembles an actual acoustic musical instrument;

wherein user voice operation of said instrument produces an output which is similar to that which is produced by the acoustic musical instrument that said enclosure resembles.

23. The instrument of claim 19, wherein said signal analysis module further comprises:

a frequency-detection module for receiving an input signal, for a calculating frequency of said input signal, and for providing an output signal indicative thereof to a sound synthesizer;

a loudness-tracking module for receiving said input signal, for determining loudness of said input signal, and for providing an output signal indicative thereof to a sound synthesizer; and a note-attack module for receiving said note signal, for determining a note on/off value and an attack value, and for producing an output indicative thereof to a sound synthesizer.

24. The instrument of claim 23, wherein the note attack module produces a loudness attack signal which is, in turn, used to generate a pre-attack sound.

25. The instrument of claim 19, further comprising:

at least one user control, wherein said user control, wherein said user control comprises any of control that switches and stays in position upon user actuation, and a control that returns upon user release.

26. The instrument of claim 25, said at least one user control further comprises:

a control that can be set in any of a continuous and a discrete pitch-tracking mode;

wherein, when said instrument is in said continuous mode and wants to select a pitch, or to sing a quick scale in a musical mode, said user can operate said control and then immediately release it when done; and wherein when said instrument is in said discrete mode, said user can quickly slide to another pitch, including a pitch outside a current musical mode, by temporarily operating said control; wherein said instrument then immediately returns to key when said user releases said control.

27. The instrument of claim 26, said at least one user control further comprises:

a control that temporarily changes said instrument to a different mode.

28. The instrument of claim 25, said at least one user control further comprises:

a control for changing between octaves.

29. The instrument of claim 19, wherein said enclosure comprises:

an inner container and an outer shell;

wherein said inner container holds said signal analysis module in a self-contained unit; and wherein said outer shell is manufactured to resemble a traditional musical instrument for any of its visual and its acoustic properties.

30. The instrument of claim 29, wherein said shell contains any of said mouthpiece and said one or more sound reproduction devices.

31. The instrument of claim 29, wherein said inner container and said outer housing are formed to fit together, wherein said shell comprises an instrument description and a communication path that provides information to said inner container comprising a description of an actual instrument sound that an instrument which said shell resembles reproduces;

wherein pulling said inner container from said shell which shell is produced in the form of one instrument and inserting it into another shell that is provided in the form of a different instrument, configures said inner container to provide a sound produced by an instrument that the shell to which said inner container is currently noted resembles.

32. The instrument of claim 31, wherein a physical key on an inner surface of said outer shell fits into a corresponding slot on an outside of said inner container to configure said instrument to reproduce a sound associated with an actual instrument having the shape represented by said outer shell.

33. The instrument of claim 31, further comprising:

a plurality of different outer shells so manufactured that said user can get not just the auditory impression, but also a tactile and visual impression of playing a specific musical instrument.

34. The instrument of claim 19, wherein said enclosure is provided in the form of any of trumpet, trombone, saxophone, oboe, bassoon, clarinet, flute, piano, electric guitar, voice, or whistle.

35. The instrument of claim 19, wherein said signal analysis module comprises means for applying a combination of auto-correlation and zero-crossing or peak-based pitch detection to said user's voice.

36. The instrument of claim 25, said at least one user control further comprising any of:

a tonic setting control for a musical mode, a musical mode selection control, and an instrument selection control for effecting either a permanent or a temporary change of said instrument, optionally by permanently or temporarily assigning an instrument to a control wherein pressing said control changes a sound produced by said instrument to a sound of another instrument that is assigned to said control until said control is released or changed.

37. A voice-controlled electronic musical instrument controller, comprising:

a funnel or cup shaped receptacle containing a microphone where the user's voice enters;

a signal analysis module for analyzing the user's voice; and an enclosure;

wherein said signal analysis module is operable to control an electronic musical instrument synthesis means; and wherein said funnel or cup shaped receptacle mutes the users voice, wherein an a synthesized instrument sound is louder relative to the user's voice.

38. The electronic musical instrument controller of claim 37, wherein the signal analysis module comprises:

a frequency-detection module for receiving an input signal, for a calculating frequency of said input signal, and for providing an output signal indicative thereof to a sound synthesizer;

a loudness-tracking module for receiving said input signal, for determining loudness of said input signal, and for providing an output signal indicative thereof to a sound synthesizer; and a note-attack module for receiving said note signal, for determining a note on/off value and an attack value, and for producing an output indicative thereof to a sound synthesizer.

39. The electronic musical instrument controller of claim 37, wherein said signal analysis module comprises means for applying a highly computationally efficient combination of auto-correlation and zero-crossing or peak-based pitch detection to said user's voice.

40. An electronic musical instrument voice control apparatus, comprising:

a microphone where the user's voice enters;

a frequency-detection module for detecting a pitch of said user's voice;

an enclosure;

wherein pitch of a sound provided by said instrument changes in response to the pitch of said user's voice;

wherein said frequency detection module comprises means for applying a combination of auto-correlation and zero-crossing or peak-based pitch detection to said user's voice; and wherein said frequency detection module is operable to control an electronic musical instrument sound synthesis means.

41. The instrument of claim 40, wherein said frequency detection module comprises:

means for determining time steps;

means for applying either of a sum of differences and a sum of products, over a small subset of recent time steps to find a correct fundamental frequency;

means for determining wave segments; and means for comparing only wave segments bounded by wave-shape features;

wherein fewer wave-shape comparisons are required before a fundamental wavelength is detected.

42. The instrument of claim 40, wherein said signal analysis module further comprises:

a frequency-detection module for receiving an input signal, for a calculating frequency of said input signal, and for providing an output signal indicative thereof to a sound synthesizer;

a loudness-tracking module for receiving said input signal, for determining loudness of said input signal, and for producing an output signal indicative thereof to a sound synthesizer; and a note-attack module for receiving said note signal, for determining a note on/off value and an attack value, and for producing an output indicative thereof to a sound synthesizer.

43. A system for voice-controlled musical performance interaction on a network comprising:

means for capturing a user's voice in response to a musical accompaniment;

a signal analysis module for analyzing the user's voice;

a sound synthesis module for receiving voice-to-pitch and musical accompaniment information;

at least one sound-reproduction device coupled to said instrument synthesis module; and a server coupled via said network to said instrument synthesis module;

wherein said server provides said accompaniment to the user and the user plays a solo along with the said accompaniment;

wherein said server provides the combination of said accompaniment and the user's performance to each member of an audience;

wherein at least one instrument sound responds to the pitch and note attacks of the user's voice; and wherein said user's performance is translated into pitch and note attack information which is transmitted at regular or semi-regular intervals to said audience via said server.

44. The system of claim 43, further comprising:

means for the audience to provide an evaluation of the user's performance to the user.

45. The system of claim 44, wherein a numerical performance score is provided to the user which represents a composite of the evaluations of all members of the audience for each performance.

46. The system of claim 44, wherein the user obtains an ability rating, wherein said ability rating reflects a composite of several performance scores.

47. A signal analysis apparatus comprising:

means for receiving acoustic information and for converting said acoustic information to a signal;

means for determining time steps;

means for either of summing differences and summing products in said signal over a small subset of recent time steps to find a correct fundamental frequency of said acoustic information;

means for determining wave segments; and means for comparing only wave segments bounded by wave-shape features such as peaks or zero crossings;

wherein fewer wave-shape comparisons are required before a fundamental wavelength is detected.

48. A signal analysis apparatus comprising:

means for receiving acoustic information and for converting said acoustic information to a signal; and means for analyzing said signal to find patterns of recurring shapes in said acoustic information by a combination of auto-correlation and zero-crossing- or peak-based pitch detection to determine a correct fundamental frequency of said acoustic information.

49. A hand-held, voice-controlled electronic musical instrument, comprising:

a mouthpiece where a user's voice enters;

a voice-to-pitch conversion module wherein said voice-to-pitch conversion module comprises a pitch-detection technique for a voice controlled musical instrument;

a loudness tracking module;

one or more user controls;

one or more sound-reproduction devices coupled to the pitch detection and loudness tracking modules; and an enclosure, said enclosure formed in a shape suggestive of a wind instrument;

wherein said mouthpiece, voice-to-pitch conversion module, one or more user controls, and one or more sound-reproduction devices are entirely contained within the confines of said enclosure; and wherein pitch and volume of said instrument change in response to said user's voice.

* * * * *